US009869461B2

(12) United States Patent
Kim et al.

(10) Patent No.: US 9,869,461 B2
(45) Date of Patent: Jan. 16, 2018

(54) LIGHT-EMITTING APPARATUS AND LIGHTING APPARATUS INCLUDING THE SAME

(71) Applicant: LG INNOTEK CO., LTD., Seoul (KR)

(72) Inventors: Ki Cheol Kim, Seoul (KR); Chang Gyun Son, Seoul (KR); Kang Yeol Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 143 days.

(21) Appl. No.: 14/935,602

(22) Filed: Nov. 9, 2015

(65) Prior Publication Data

US 2016/0131354 A1 May 12, 2016

(30) Foreign Application Priority Data

Nov. 11, 2014 (KR) ..... 10-2014-0156035

(51) Int. Cl.

| | |
|---|---|
| ***F21V 29/63*** | (2015.01) |
| ***F21V 9/16*** | (2006.01) |
| ***F21V 29/502*** | (2015.01) |
| ***F21V 7/05*** | (2006.01) |
| ***F21K 9/64*** | (2016.01) |
| *F21Y 115/30* | (2016.01) |
| *F21Y 115/10* | (2016.01) |

(52) U.S. Cl.

CPC ..... *F21V 29/63* (2015.01); *F21K 9/64* (2016.08); *F21V 7/05* (2013.01); *F21V 9/16* (2013.01); *F21V 29/502* (2015.01); *F21Y 2115/10* (2016.08); *F21Y 2115/30* (2016.08)

(58) Field of Classification Search

CPC ..... F21V 29/63; F21V 29/502; F21V 7/05; F21V 9/06; F21K 9/64; F21Y 2115/30; F21Y 2115/10

USPC ..... 362/84

See application file for complete search history.

(56) References Cited

U.S. PATENT DOCUMENTS

| | | | | |
|---|---|---|---|---|
| 2009/0015388 | A1* | 1/2009 | Yagi | B60Q 1/0035 340/435 |
| 2009/0034201 | A1 | 2/2009 | Brandes | |
| 2009/0046474 | A1* | 2/2009 | Sato | B60Q 1/076 362/466 |
| 2011/0127914 | A1* | 6/2011 | Patton et al. | F21S 10/04 315/76 |
| 2012/0051058 | A1 | 3/2012 | Sharma et al. | |
| 2013/0010492 | A1 | 1/2013 | Montgomery et al. | |
| 2014/0240993 | A1 | 8/2014 | Seeley et al. | |

(Continued)

OTHER PUBLICATIONS

European Search Report for European Patent Application No. 15193636.6.

*Primary Examiner* — Laura Tso

(74) *Attorney, Agent, or Firm* — LRK Patent Law Firm

(57) ABSTRACT

Embodiments provide a light-emitting apparatus including a light source, a carrier spaced apart from the light source in an optical-axis direction, a wavelength converter disposed in a first area of the carrier and configured to convert a wavelength of light emitted from the light source, and at least one coil and at least one magnet disposed in a second area of the carrier and configured to generate electromagnetic force so as to vibrate the carrier in at least one vibration direction, the vibration direction being different from the optical-axis direction.

20 Claims, 20 Drawing Sheets

(56) References Cited

U.S. PATENT DOCUMENTS

| | | | | |
|---|---|---|---|---|
| 2014/0254188 | A1* | 9/2014 | Masuda et al. ..... | B60Q 1/0023<br>362/521 |
| 2016/0109100 | A1* | 4/2016 | Kim ..... | B60Q 1/18<br>362/259 |

* cited by examiner

LIGHT-EMITTING APPARATUS AND LIGHTING APPARATUS INCLUDING THE SAME

CROSS REFERENCE TO RELATED APPLICATION

This application claims priority under 35 U.S.C. §119 to Korean Patent Application No. 10-2014-0156035, filed on Nov. 11, 2014, which is hereby incorporated in its entirety by reference as if fully set forth herein.

BACKGROUND OF THE INVENTION

1. Field of the Invention

Embodiments relate to a light-emitting apparatus and a lighting apparatus including the light-emitting apparatus.

2. Description of Related Art

Semiconductor Light-Emitting Diodes (LEDs) are semiconductor devices that convert electricity into infrared light or ultraviolet light using the characteristics of compound semiconductors so as to enable transmission/reception of signals, or that are used as a light source.

Group III-V nitride semiconductors are in the spotlight as core materials of light emitting devices such as, for example, LEDs or Laser Diodes (LDs) due to physical and chemical characteristics thereof.

The LEDs or LDs do not include environmentally harmful materials such as mercury (Hg) that are used in conventional lighting appliances such as, for example, fluorescent lamps and incandescent bulbs, and thus are very eco-friendly, and have several advantages such as, for example, long lifespan and low power consumption. As such, conventional light sources are being rapidly replaced with LEDs or LDs.

The fields in which these light-emitting devices are used are becoming widening. For example, in the case where light-emitting devices are applied to a light-emitting apparatus including phosphors, excited light emitted from the light-emitting devices may be concentrated on an extremely small area occupied by the phosphors, thus causing the generation of excessive heat. Thereby, thermal quenching, which causes a considerable reduction in light output, may occur because the light conversion efficiency of the phosphors is reduced at a high temperature. Therefore, in order to prevent thermal quenching without reducing the output level of excited light, it is necessary to effectively spread and radiate heat generated in the phosphors.

SUMMARY

Embodiments provide a light-emitting apparatus having excellent heat radiation performance and a lighting apparatus including the light-emitting apparatus.

In one embodiment, a light emitting apparatus includes a light source, a carrier spaced apart from the light source in an optical-axis direction, a wavelength converter disposed in a first area of the carrier and configured to convert a wavelength of light emitted from the light source, and at least one coil and at least one magnet disposed in a second area of the carrier and configured to generate electromagnetic force so as to vibrate the carrier in at least one vibration direction, the vibration direction being different from the optical-axis direction.

For example, the carrier may include a first hole formed in the first area so as to receive the wavelength converter therein.

For example, the carrier may further include a second hole configured to face a bottom surface of the wavelength converter seated in the first hole, the second hole being deeper than the first hole.

For example, the carrier may further include a first through-hole for transmission of the light emitted from the light source toward the wavelength converter.

For example, the second hole may include a first through-hole for transmission of the light emitted from the light source toward the wavelength converter.

For example, the at least one vibration direction may include a plurality of different vibration directions, the second area may include at least one second-first area extending from the first area in one vibration direction among the vibration directions, and/or at least one second-second area extending from the first area in another vibration direction among the vibration directions, the at least one coil may include a plurality of coils arranged respectively in the second-first area and the second-second area, and the at least one magnet may include a plurality of magnets arranged to be opposite to the respective coils.

For example, at least two of the vibration directions may be perpendicular to each other. At least one of the vibration directions may be perpendicular to the optical-axis direction. Levels of current flowing through the respective coils may be the same. Alternatively, at least two of levels of current flowing through the respective coils may be different. Levels of current flowing through the respective coils may be periodically or non-periodically changed.

For example, the at least one second-first area may include a second-first-first area and a second-first-second area arranged to be symmetrical to each other with the first area interposed therebetween, and the at least one second-second area may include a second-second-first area and a second-second-second area arranged to be symmetrical to each other with the first area interposed therebetween.

For example, the light-emitting apparatus may further include a radiator substrate disposed between the carrier and the wavelength converter.

For example, the radiator substrate may comprise a light transmitting material or a reflective material.

For example, the light-emitting apparatus may further include a reflective layer disposed between the wavelength converter and the first hole.

In another embodiment, a lighting apparatus may include the light-emitting apparatus, and a reflector configured to reflect light via the wavelength converter after being emitted from the light source.

For example, the lighting apparatus may further include a base substrate configured to support the reflector, the base substrate having a second through-hole for transmission of the light via the wavelength converter.

For example, the wavelength converter may be disposed below the base substrate so as to be opposite to the second through-hole. The reflector may include a third through-hole for passage of the light emitted from the light source toward the wavelength converter.

For example, the base substrate may include a third hole seating of the carrier and a fourth hole extending from the third hole for seating of the coil and the magnet.

For example, the lighting apparatus may further include a return spring connected between a side portion of the carrier and the base substrate within the third hole of the base substrate.

For example, the first area may be located at or near a center of the carrier, and the second area is radially branched from the first area.

BRIEF DESCRIPTION OF THE DRAWINGS

Arrangements and embodiments may be described in detail with reference to the following drawings in which like reference numerals refer to like elements and wherein.

DESCRIPTION OF SPECIFIC EMBODIMENTS

Hereinafter, exemplary embodiments will be described in detail with reference to the accompanying drawings to aid in understanding of the embodiments. However, the embodiments may be altered in various ways, and the scope of the embodiments should not be construed as limited to the following description. The embodiments are intended to provide those skilled in the art with more complete explanation.

In the following description of the embodiments, it will be understood that, when each element is referred to as being formed "on" or "under" the other element, it can be directly "an" or "under" the other element or be indirectly formed with one or more intervening elements therebetween.

In addition, it will also be understood that "on" or "under" the element may mean an upward direction and a downward direction of the element.

In addition, the relative terms "first", "second", "upper", "lower" and the like in the description and in the claims may be used to distinguish between any one substance or element and other substances or elements and not necessarily for describing any physical or logical relationship between the substances or elements or a particular order.

Hereinafter, light-emitting apparatuses 100A to 100F and lighting apparatuses 200A to 200D according to the embodiments will be described with reference to the accompanying drawings. For convenience, although the light-emitting apparatuses 100A to 100F and the lighting apparatuses 200A to 200D will be described using the Cartesian coordinate system (comprising the x-axis, the y-axis, and the z-axis), of course, it may be described using other coordinate systems. In addition, although the x-axis, the y-axis, and the z-axis in the Cartesian coordinate system are perpendicular to one another, the embodiments are not limited thereto. That is, the x-axis, the y-axis, and the z-axis may cross one another, rather than being perpendicular to one another.

Figure 1:
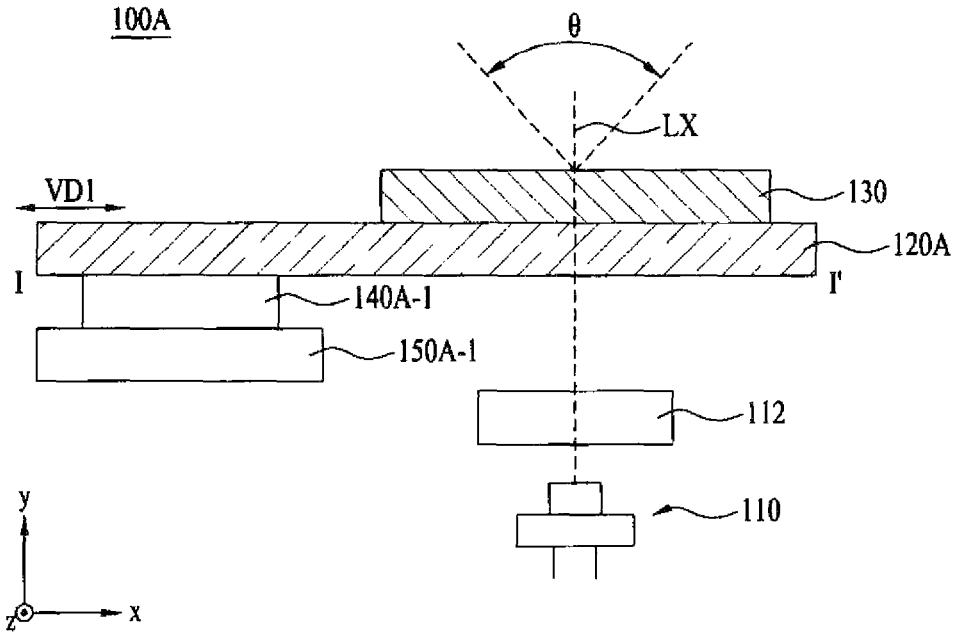
FIG. 1 is a sectional view of a light-emitting apparatus according to one embodiment.
Figure 2:
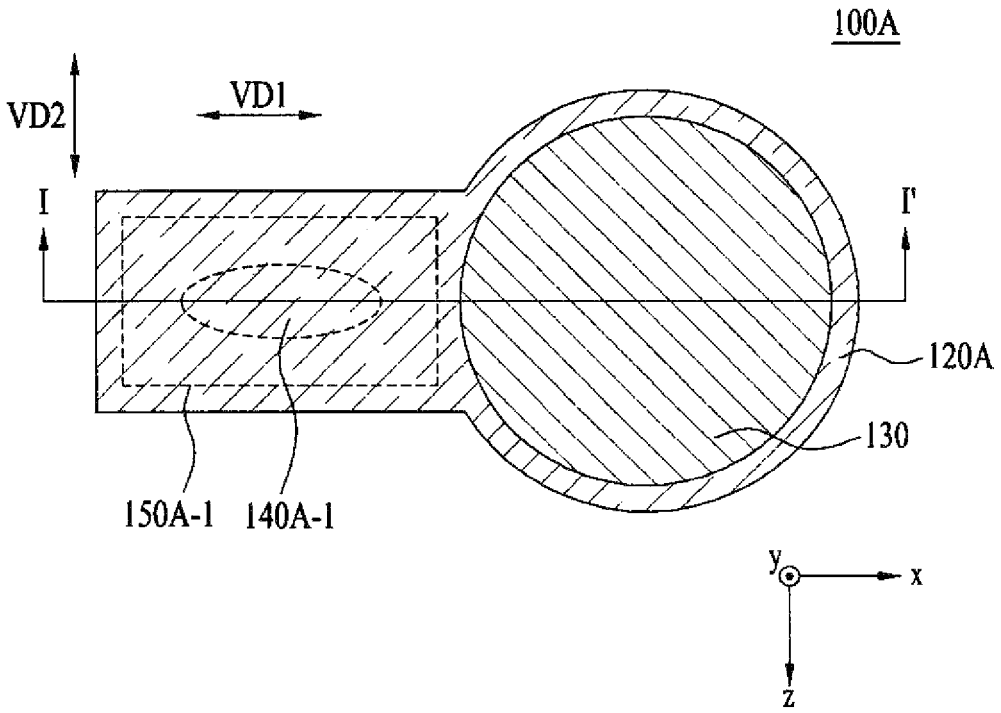
FIG. 2 is a plan view of the light-emitting apparatus illustrated in FIG. 1.

FIG. 1 is a sectional view of a light-emitting apparatus 100A according to one embodiment, and FIG. 2 is a plan view of the light-emitting apparatus 100A illustrated in FIG. 1.

Although FIG. 1 corresponds to a sectional view of the light-emitting apparatus 100A illustrated in FIG. 2 taken along line I-I', the embodiment is not limited thereto. That is, the light-emitting apparatus 100A illustrated in FIG. 1 may have any of various shapes in a plan view excluding the plan view illustrated in FIG. 2, and the light-emitting apparatus 100A illustrated in FIG. 2 may have any of various shapes in a sectional view excluding the sectional view illustrated in FIG. 1.

The light-emitting apparatus 100A illustrated in FIGS. 1 and 2 may include a light source 110, a light transmitting layer 112, a carrier 120A, a wavelength converter 130, a coil 140A-1, and a magnet 150A-1.

To assist the understanding of the embodiment, in FIG. 2, the coil 140A-1 and the magnet 150A-1, hidden by the carrier 120A, are illustrated by dotted lines.

The light source 110 serves to emit light. Although the light source 110 may include at least one of Light-Emitting Diodes (LEDs) or Laser Diodes (LDs), the embodiment is not limited as to the kind of the light source 110.

In the case of FIGS. 1 and 2, although a single light source 110 is illustrated, the embodiment is not limited as to the number of light sources. That is, there may be a plurality of light sources 110.

Although the light emitted from the light source 110 may have any peak wavelength in the wavelength band from 400 nm to 500 nm, the embodiment is not limited as to the wavelength band of the emitted light. The light source 110 may emit light having a Spectral Full Width at Half Maximum (SFWHM) of 10 nm or less. The SFWHM corresponds to the width of a wavelength depending on intensity. However, the embodiment is not limited to any specific value of the SFWHM. In addition, although the FWHM of light, emitted from the light source 110 and introduced into the wavelength converter 130, i.e. the size of light beams may be 1 nm or less, the embodiment is not limited thereto.

The light transmitting layer 112 may be disposed in a path along which the light emitted from the light source 110 passes toward the wavelength converter 130. The light transmitting layer 112 may include a transparent medium, the index of refraction of which is 1, the same as that of air, or may include a transparent medium, the index of refraction of which is greater than 1 and equal to or less than 2, and the embodiment is not limited thereto.

In some cases, the light-emitting apparatus 100A may not include the light transmitting layer 112.

Meanwhile, the carrier 120A may be disposed to be spaced apart from the light source 110 by a given distance in the direction of the optical axis LX of the light source 110. This serves to prevent the carrier 120A from being affected by heat generated from the light source 110.

Figure 3A:
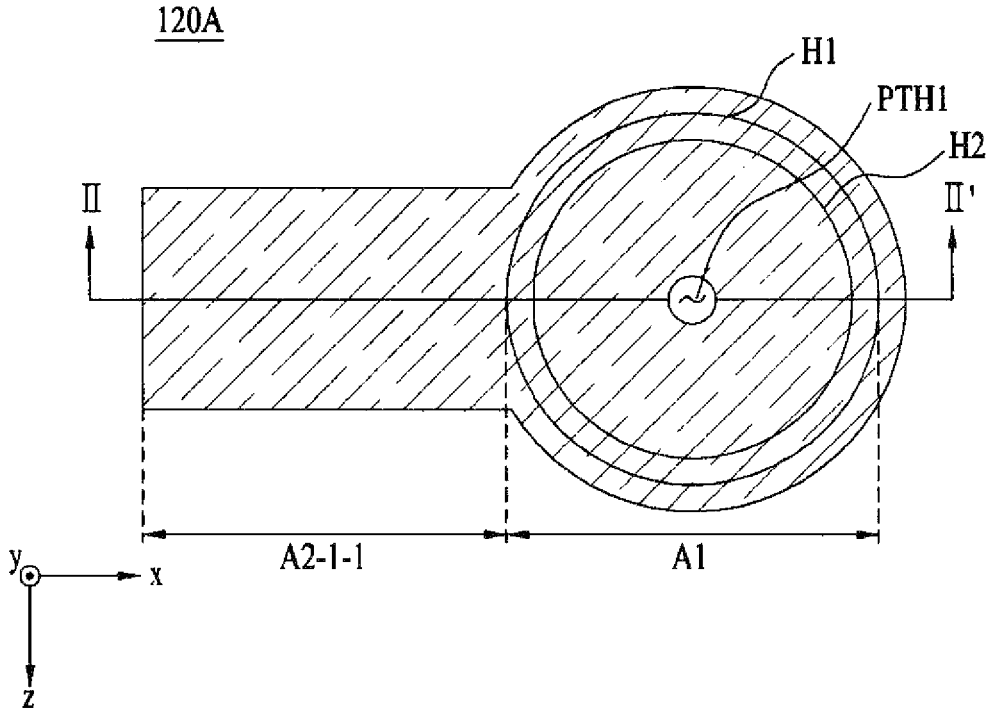
FIG. 3A is a plan view of a carrier illustrated in FIGS. 1 and 2 according to one embodiment.
Figure 3B:
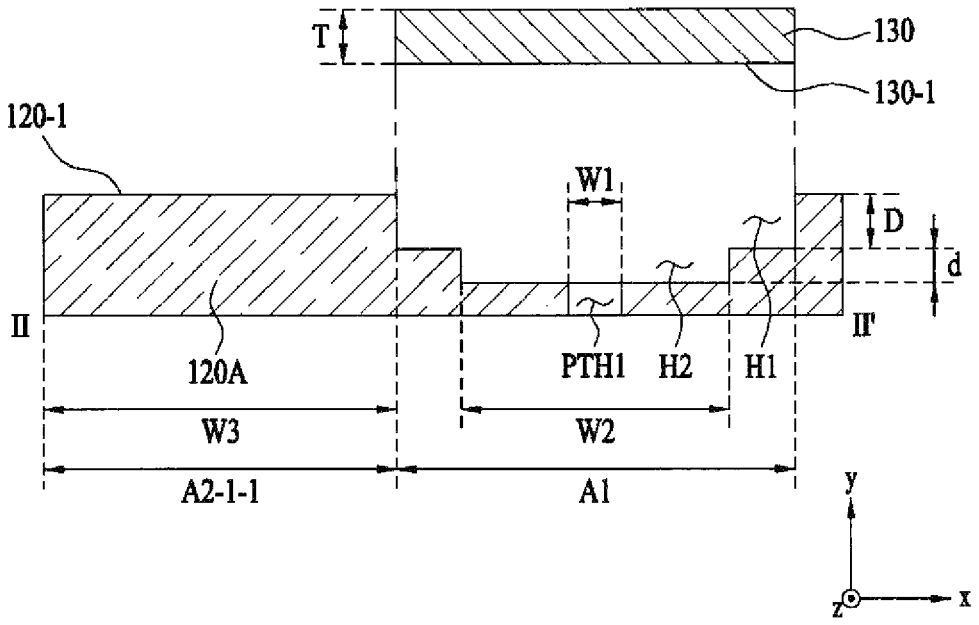
FIG. 3B is an exploded sectional view of the carrier and a wavelength converter.

FIG. 3A is a plan view of the carrier 120A illustrated in FIGS. 1 and 2 according to the embodiment, and FIG. 3B is an exploded sectional view of the carrier 120A and the wavelength converter 130. The carrier 120A illustrated in FIG. 3B corresponds to a sectional view of the carrier 120A illustrated in FIG. 3A taken along line II-II'.

Referring to FIGS. 3A and 3B, the carrier 120A may include a first area A1 and a second area A2; A2-1-1. The first and second areas A1 and A2 may be disposed to be divided in the direction (e.g. the vibration direction VD1 and VD2) perpendicular to the optical axis LX.

The first area A1 is the area, in which the wavelength converter 130 is located, of the carrier 120A and may include a first hole H1 configured to receive the wavelength converter 130 therein. For example, the first area A1 may be located at or near the center of the carrier 120A.

The depth D of the first hole H1 of the carrier 120A may be greater than or smaller than, or equal to the thickness T of the wavelength converter 130. FIG. 1 illustrates the case where the thickness T of the wavelength converter 130 is greater than the depth D of the first hole H1 of the carrier 120A. In this case, as exemplarily illustrated in the sectional view of FIG. 1, the wavelength converter 130 received in the first hole H1 may protrude from an upper surface 120-1 of the carrier 120A.

In addition, the first area A1 may further include a second hole H2. The second hole H2 is deeper than the first hole H1 in the first area A1 of the carrier 120A, so as to face a bottom surface 130-1 of the wavelength converter 130 seated in the first hole H1. When the second hole H2 is formed as described above, the bottom surface 130-1 of the wavelength converter 130 seated in the first hole H1 is spaced apart from the carrier 120A by a given distance d in the direction of the optical axis LX (e.g., the y-axis), which may ensure the efficient radiation of heat generated in the wavelength converter 130. In some cases, the second hole H2 may be omitted.

In addition, as exemplarily illustrated in FIGS. 3A and 3B, the first area A1 of the carrier 120A may further include a first through-hole PTH1. The first through-hole PTH1 allows light emitted from the light source 110 to be introduced toward the wavelength converter 130. The first width W1 of the first through-hole PTH1 may be equal to or less than the second width W2 of the second hole H2.

As exemplarily illustrated in FIG. 10 that will be described below, when the first width W1 of the first through-hole PTH1 is equal to the second width W2 of the second hole H2, the second hole H2 may serve as the first through-hole PTH1.

Generally, the viewing angle of light-emitting diodes is wider than the viewing angle of laser diodes. Thus, laser diodes having a narrower viewing angle than light-emitting diodes may be advantageously used in the light source 110 in terms of the introduction of light into the first through-hole PTH1. However, in the case where an optical system (not illustrated) capable of reducing the viewing angle is located between the light source 110, i.e. the light-emitting diodes and the first through-hole PTH1, the optical system may reduce the viewing angle of light emitted from the light-emitting diodes so as to introduce the light into the first through-hole PTH1. As such, the light-emitting diodes may be used as the light source 110.

In addition, although the laser diodes may be used in the light source 110 owing to higher efficiency and higher brightness than other kinds of light sources, the embodiment is not limited thereto. That is, the light-emitting diodes or the laser diodes may be used in the light source 110 according to the use of the light-emitting apparatus 100A.

In addition, the light source 110 may be spaced apart from the wavelength converter 130 (or the first through-hole PTH1) by a given distance. When the two 110 and 130 are not spaced apart from each other, or are spaced apart from each other by a small distance, the wavelength converter 130 may be affected by heat generated from the light source 110. Therefore, the distance may be determined in consideration of this.

In addition, as exemplarily illustrated in FIG. 3A, at least one of the first or second holes H1 or H2 may have a circular shape in plan view, the embodiment is not limited thereto. That is, in another embodiment, of course, at least one of the first or second holes H1 or H2 may have any of various other planar shapes such as, for example, a polygonal shape or an elliptical shape.

The wavelength converter 130, placed in the first area A1 of the carrier 120A, may convert the wavelength of the light emitted from the light source 110. While the light emitted from the light source 110 is introduced into the first through-hole PTH1 and passes through the wavelength converter 130, the wavelength of the light may be changed. However, not all of the light that has passed through the wavelength converter 130 may be wavelength-converted light.

Referring again to FIG. 1, after the wavelength of the light emitted from the light source 110 is converted in the wavelength converter 130, the light may be emitted at a prescribed angle θ. To this end, the wavelength converter 130 may include at least one of a fluorescent material and phosphors, for example, at least one of ceramic phosphors, lumiphors, and YAG single-crystals. Here, the term "lumiphors" means a luminescent material or a structure including a luminescent material.

In addition, light having a desired color temperature may be emitted from the light-emitting apparatus 100A via adjustment in, for example, the concentration, particle size, and particle-size distribution of various materials included in the wavelength converter 130, the thickness of the wavelength converter 130, the surface roughness of the wavelength converter 130, and air bubbles.

Meanwhile, referring again to FIGS. 1 and 2, the coil 140A-1 and the magnet 150A-1, which are formed of metal materials, may be disposed in the second area A2; A2-1-1 of the carrier 120A, so as to generate electromagnetic force required of the vibration of the carrier 120A in at least one vibration direction that is different from the direction of the optical axis LX (e.g. the y-axis).

Although the at least one vibration direction may be the direction perpendicular to the direction of the optical axis LX, the embodiment is not limited thereto. As exemplarily illustrated in FIGS. 1 and 2, the vibration direction may be the x-axis VD1 perpendicular to the y-axis. That is, the carrier 120A may vibrate in the x-axis by electromagnetic force induced by the coil 140A-1 and the magnet 150A-1. As compared to the case where the carrier 120A does not vibrate, a greater amount of heat generated in the wavelength converter 130 may be discharged through the vibrating carrier 120A when the carrier 120A vibrates.

Hereinafter, although the electromagnetic force induced by the coil 140A-1 and the magnet 150A-1 will be described with reference to FIGS. 4 and 5, the embodiment is not limited thereto.

Figure 4:
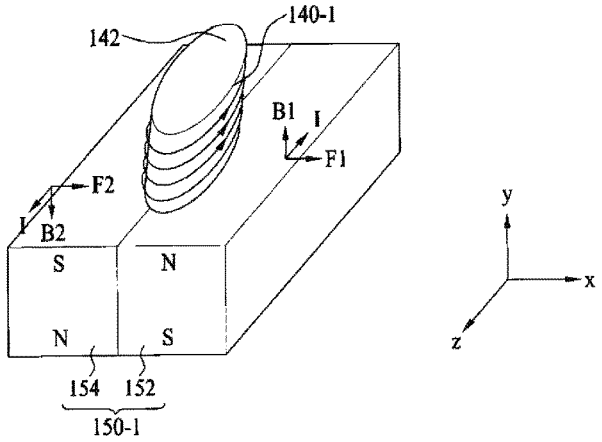
FIG. 4 is a perspective view illustrating one embodiment of a coil and a magnet illustrated in FIG. 1.

FIG. 4 is a perspective view illustrating one embodiment 140-1 and 150-1 of the coil 140A-1 and the magnet 150A-1 illustrated in FIG. 1.

As exemplarily illustrated in FIG. 4, the coil 140-1 may be wound around a bobbin 142. Current I may flow in the direction of the arrow, or may flow in the direction opposite to the direction of the arrow.

In addition, the magnet 150-1 may include a first magnet 152 and a second magnet 154 which are bipolar magnets. At this time, the first and second magnets 152 and 154 may be arranged adjacent to each other in they-axis.

When the current I flows through the coil 140-1 in the direction of the arrow as illustrated in FIG. 4 and a first magnetic field B1 is generated in the +y-axis by the first magnet 152, first electromagnetic force F1 may be generated in the +x-axis by Fleming's left-hand law. In addition, when the current I flows through the coil 140-1 in the direction of the arrow as illustrated in FIG. 4 and a second magnetic field B2 is generated in the −y-axis by the second magnet 154, second electromagnetic force F2 may be generated in the +x-axis by Fleming's left-hand law. As such, the first and second electromagnetic force F1 and F2 may be generated in the +x-axis. However, when the current I flows through the coil 140-1 in the direction opposite to the direction of the arrow in FIG. 4, the first and second electromagnetic force F1 and F2 may be generated in the −X-axis.

As described above, when the flow direction of the current I is alternately changed in order to alternately generate the first and second electromagnetic force F1 and F2 in the +x-axis and the −X-axis, the first and second electromagnetic force F1 and F2 may be alternately generated in the +x-axis and the −X-axis. The first and second electromagnetic force F1 and F2 may allow the carrier 120A, on which the coil 140-1 and the magnet 150-1 are disposed, to alternately move in the +x-axis and the −X-axis. That is, the carrier 120A may vibrate in the first vibration direction VD1 illustrated in FIGS. 1 and 2.

Figure 5:
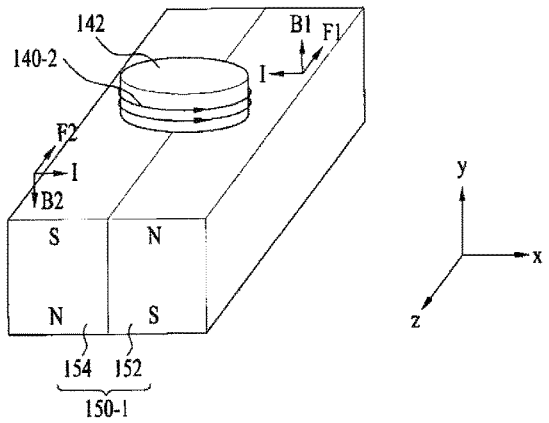
FIG. 5 is a perspective view illustrating another embodiment of the coil and the magnet illustrated in FIG. 1, respectively.
Figure 6A:
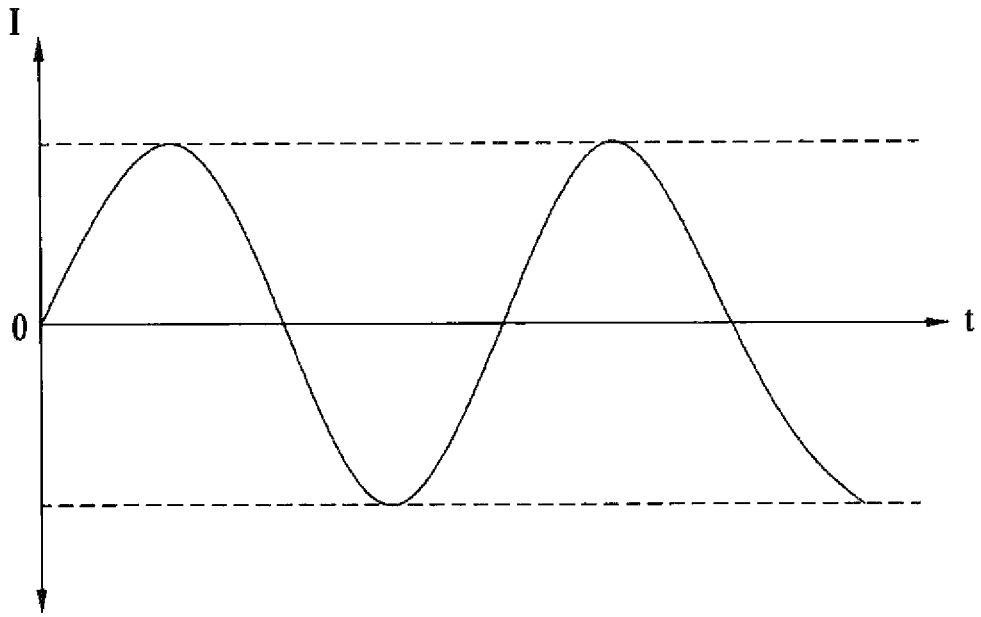
FIGS. 6A to 6D are graphs illustrating various forms of current flowing through the coil.
Figure 6B:
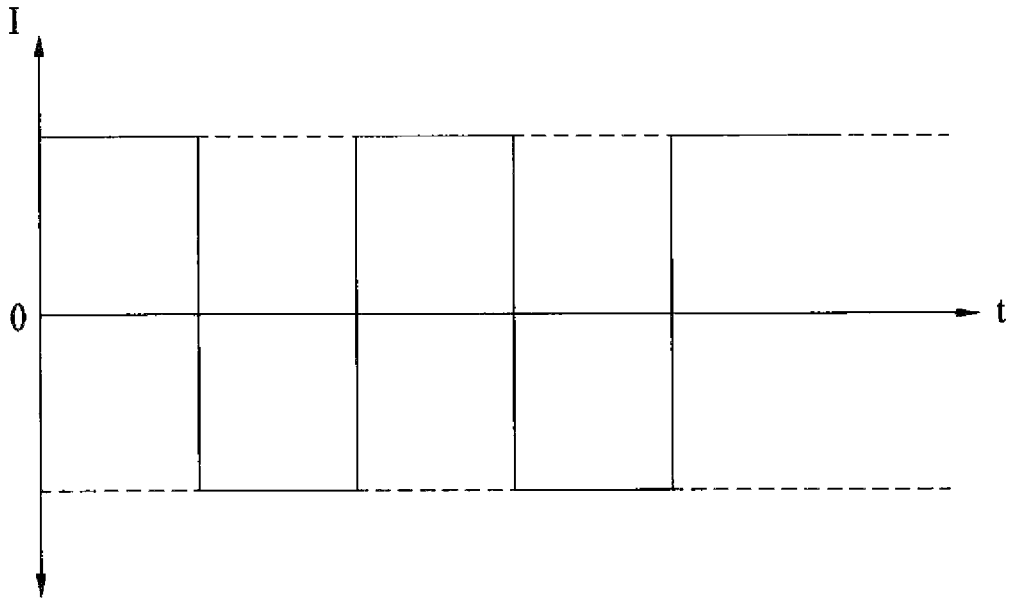
Figure 6C:
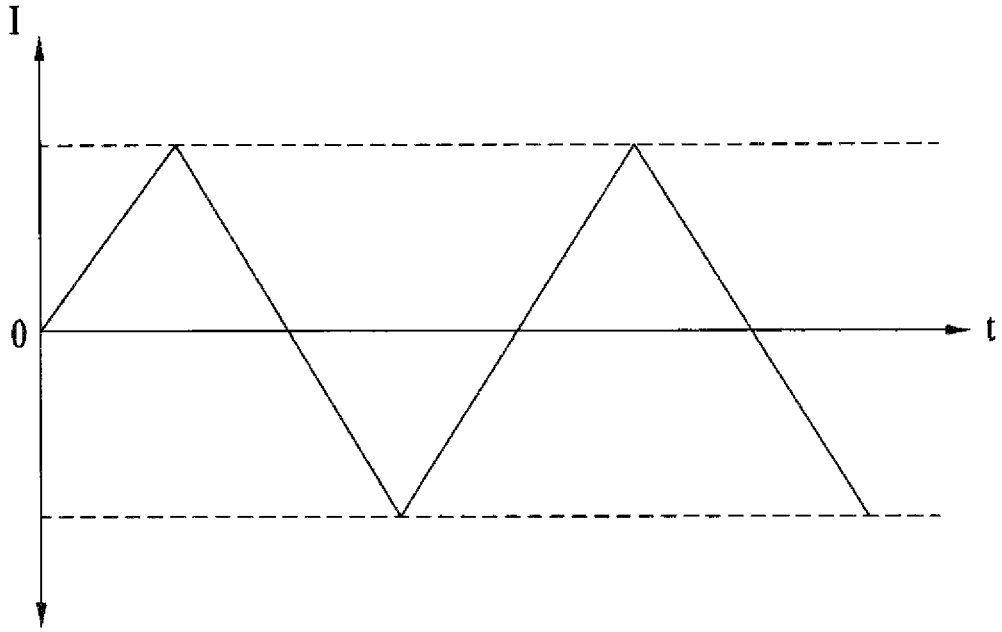
Figure 6D:
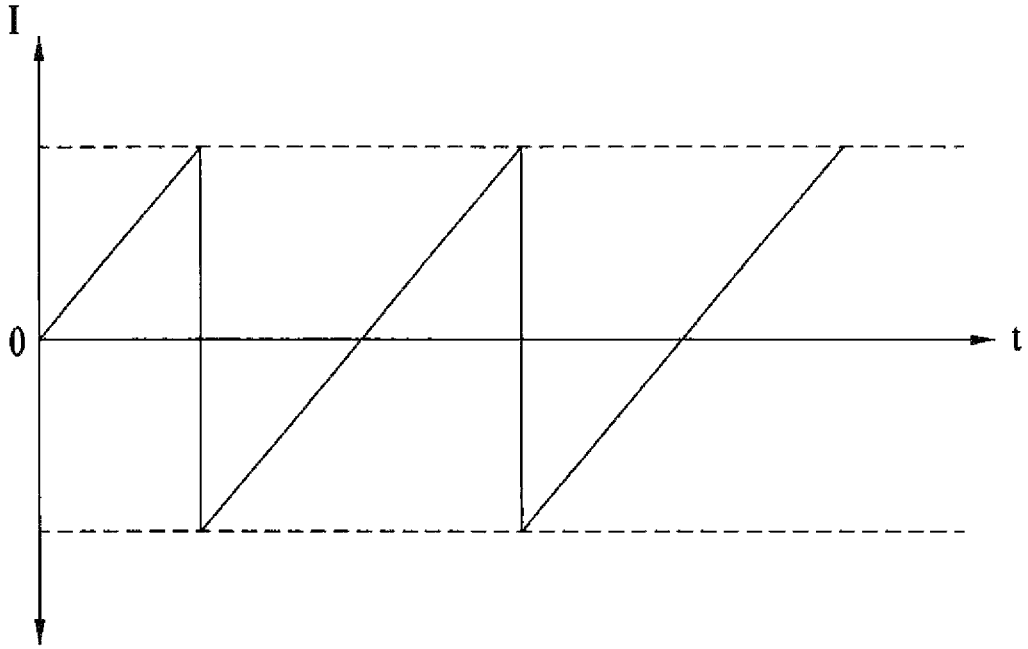

FIG. 5 is a perspective view illustrating another embodiment 140-2 and 150-1 of the coil 140A-1 and the magnet 150A-1 illustrated in FIG. 1, respectively.

Excluding the difference in the direction of the current I flowing through the coil 140-1 illustrated in FIG. 4, the coil 140-2 and the magnet 150-1 illustrated in FIG. 5 are respectively the same as the coil 140-1 and the magnet 150-1, and thus a repeated description thereof will be omitted below. That is, the coil 140-2 illustrated in FIG. 5 may be wound around the bobbin 142, and the current I may flow in the direction of the arrow, or may flow in the direction opposite to the direction of the arrow.

When the current I flows through the coil 140-2 in the direction of the arrow as illustrated in FIG. 5 and the first magnetic field B1 is generated in the +y-axis by the first magnet 152, first electromagnetic force F1 may be generated in the −z-axis by Fleming's left-hand law. In addition, when the current I flows through the coil 140-2 in the direction of the arrow as illustrated in FIG. 5 and a second magnetic field B2 is generated in the −y-axis by the second magnet 150-1, second electromagnetic force F2 may be generated in the −z-axis by Fleming's left-hand law. As such, the first and second electromagnetic force F1 and F2 may be generated in −z-axis.

However, when the current I flows through the coil 140-2 in the direction opposite to the direction of the arrow in FIG. 5, the first and second electromagnetic force F1 and F2 may be generated in the +z-axis.

As described above, when the flow direction of the current I is alternately changed in order to alternately generate the first and second electromagnetic force F1 and F2 in the −z-axis and the +z-axis, the first and second electromagnetic force F1 and F2 may be alternately generated in the −z-axis and the +z-axis. The first and second electromagnetic force F1 and F2 may allow the carrier 120A, on which the coil 140-2 and the magnet 150-1 are disposed, to alternately move in the −z-axis and the +z-axis. That is, the carrier 120A may vibrate in the second vibration direction VD2 illustrated in FIG. 2.

As exemplarily illustrated in FIGS. 4 and 5, the direction in which the carrier 120A vibrates may be changed as the direction of the current I is changed. In addition, the vibration degree of the carrier 120A may be adjusted as the intensity of the current I is changed.

For example, although the vibration width of the carrier 120A in the first vibration direction VD1 may be greater than zero and may be smaller than a half W3/2 the third width W3 of a second-first area A2-1-1, the embodiment is not limited thereto.

FIGS. 6A to 6D are graphs illustrating various forms of current flowing through the coil 140A-1, 140-1 or 140-2. The vertical axis represents the level of the current I, and the horizontal axis represents time t.

The current I may have various forms in such a manner that the level of the current I is periodically or non-periodically (or randomly) changed to a positive or negative value. For example, the current I may take the form of a sine wave illustrated in FIG. 6A, may take the form of a square or rectangular wave illustrated in FIG. 6B, may take the form of a triangular wave illustrated in FIG. 6C, or may take the form of a sawtooth wave illustrated in FIG. 6D, the embodiments are not limited thereto.

Meanwhile, although FIGS. 3A and 3B illustrates a single second area A2 in which the first coil 140A-1, 140-1 or 140-2 and the magnet 150A-1 or 150-1 are arranged, the embodiments are not limited thereto.

Hereinafter, the second area A2 will be described in more detail.

The second area A2 may include at least one of at least one second-first area or at least one second-second area. Here, the second-first area may be defined as at least one area that extends from the first area A1 in one vibration direction among a plurality of vibration directions. The second-second area may include at least one area that extends from the first area A1 in another vibration direction among the vibration directions. Here, at least two of the vibration directions may be perpendicular to each other. In addition, at least one of the vibration directions may be perpendicular to the single optical axis LX.

A coil and a magnet, which are opposite to each other, may be arranged in each of the second-first area and the second-second area. That is, a plurality of coils and a plurality of magnets may be provided. In this case, the levels of current flowing through the respective coils may be the same. Alternatively, at least two of the levels of the current flowing through the respective coils may be different. In addition, the level of the current flowing through the respective coils may be periodically or non periodically changed.

In addition, as described above, when the first area A1 is located at or near the center of the carrier 120A, the second area A2 may include at least one area radially branched from the first area A1 of the carrier 120A, for example, the second-first area and the second-second area. In the carrier 120A illustrated in FIGS. 3A and 3B, the second area A2 includes only the second-first area A2-1-1.

Figure 7:
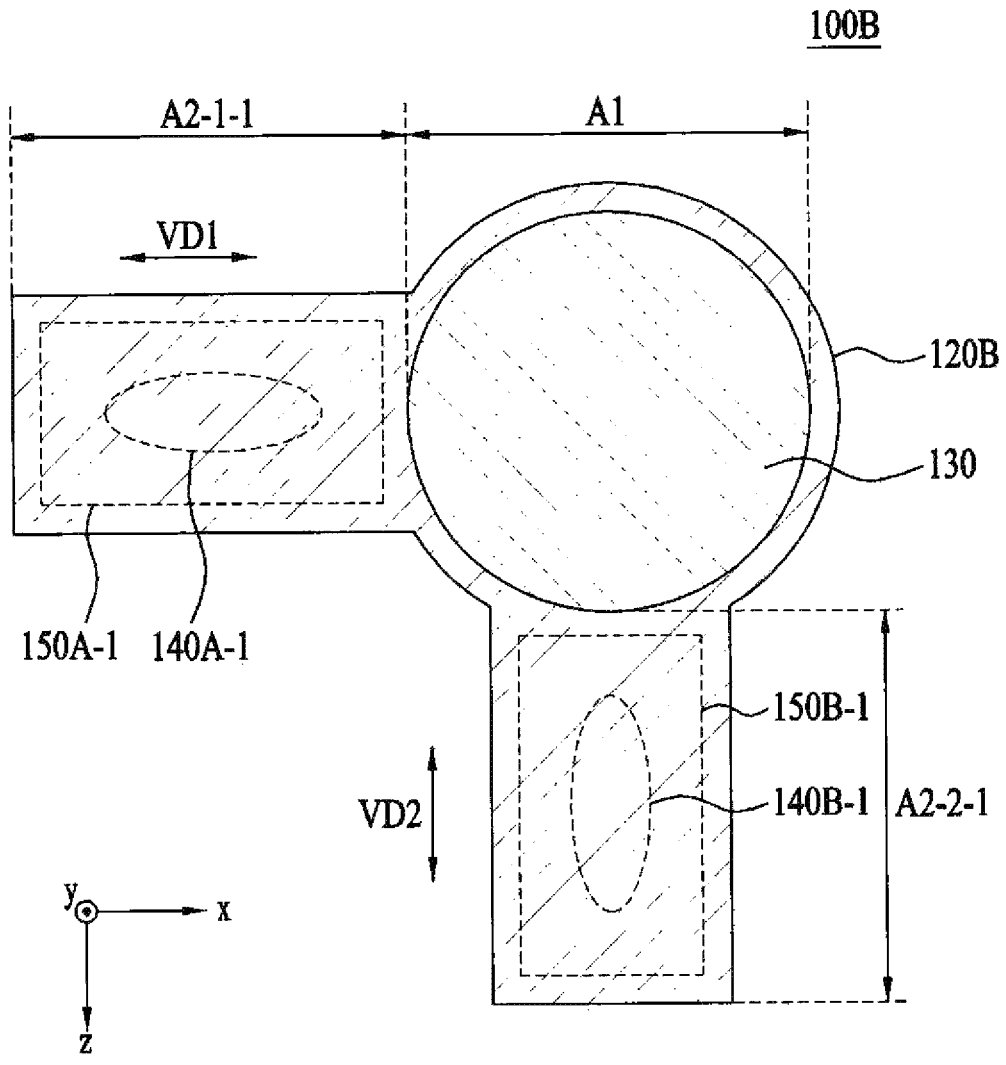
FIG. 7 is a plan view of a light-emitting apparatus according to another embodiment.
Figure 8:
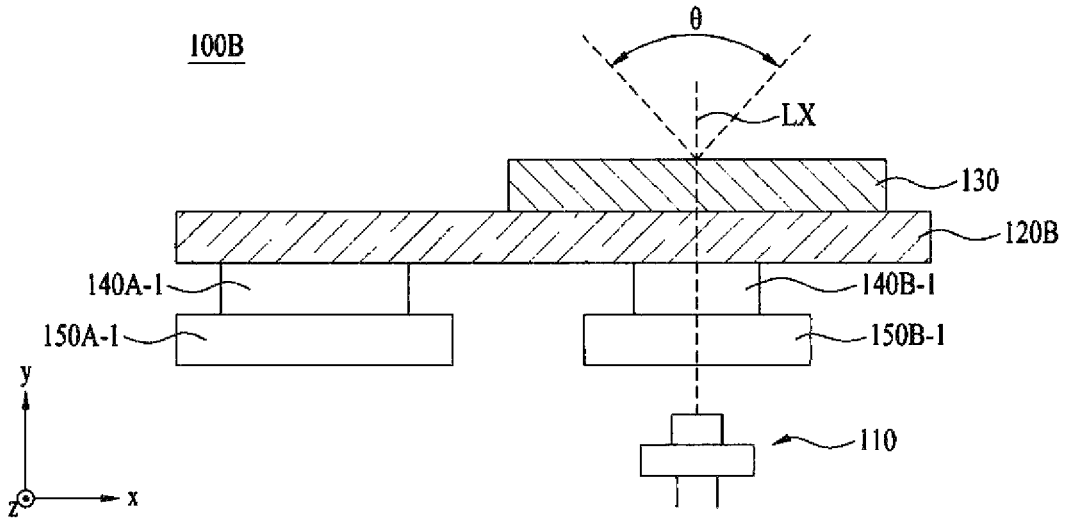
FIG. 8 is a sectional view of the light-emitting apparatus illustrated in FIG. 7 when viewed in the −Z-axis direction.

FIG. 7 is a plan view of a light-emitting apparatus 100B according to another embodiment, and FIG. 8 is a sectional view of the light-emitting apparatus 100B illustrated in FIG. 7 when viewed in the −Z-axis direction.

The light-emitting apparatus 100B illustrated in FIG. 7 may have any of various shapes in a sectional view excluding the sectional view illustrated in FIG. 8, and the light-emitting apparatus 100B illustrated in FIG. 8 may have any of various shapes in a plan view excluding the plan view illustrated in FIG. 7.

The light-emitting apparatus 100B illustrated in FIGS. 7 and 8 includes the light source 110, a carrier 120B, the wavelength converter 130, first-first and second-first coils 140A-1 and 140B-1, and first-first and second-first magnets 150A-1 and 150B-1. Here, although the light transmitting layer 112 illustrated in FIGS. 1 and 2 is omitted, of course, the light transmitting layer 112 may be located between the light source 110 and the wavelength converter 130 as illustrated in FIGS. 1 and 2.

To assist the understanding of the embodiment, in FIG. 7, the first-first and second-first coils 140A-1 and 140B-1 and the first-first and second-first magnets 150A-1 and 150B-1, hidden by the carrier 120B, are illustrated by dotted lines.

The light source 110, the wavelength converter 130, the first-first coil 140A-1, and the first-first magnet 150A-1 illustrated in FIGS. 7 and 8 are respectively the same as the light source 110, the wavelength converter 130, the coil 140A-1, and the 150A-1 illustrated in FIGS. 1 and 2, and thus are designated by the same reference numerals, and a detailed description thereof will be omitted below.

In addition, although the wavelength converter 130 on the carrier 120B illustrated in FIGS. 7 and 8 may have a plan shape and a cross-sectional shape as illustrated in FIGS. 3A and 3B, the embodiment is not limited thereto.

Referring to FIGS. 7 and 8, the first area A1 is the area in which the wavelength converter 130 is placed as exemplarily illustrated in FIG. 3B.

The second-first area may include a single second-first-first area A2-1-1 that extends from the first area A1 in one first vibration direction VD1 among the first and second vibration directions VD1 and VD2. Here, the second-first-first area A2-1-1 is as illustrated in FIGS. 3A and 3B.

In addition, the second-second area may include a second-second-first area A2-2-1 that extends from the first area A1 in the other second vibration direction VD2 among the first and second vibration directions VD1 and VD2.

The first-first coil 140A-1 and the first-first magnet 150A-1 may be arranged in the second-first-first area A2-1-1, and the second-first coil 140B-1 and the second-first magnet 150B-1 may be arranged in the second-second-first area A2-2-1.

The first-first and second-first magnets 150A-1 and 150B-1 may be arranged so as to be opposite to the first-first and second-first coils 140A-1 and 140B-1 respectively.

In addition, the first-first coil 140A-1 and the first-first magnet 150A-1 illustrated in FIGS. 7 and 8 may be arranged in the same form as the coil 140-1 and the magnet 150-1 illustrated in FIG. 4, and serve to vibrate the carrier 120B in the first vibration direction VD1. In addition, the second-first coil 140B-1 and the second-first magnet 150B-1 may be arranged in the same form as the cod 140-2 and the magnet 150-1 illustrated in FIG. 5, and serve to vibrate the carrier 120B in the second vibration direction VD2. The operation of vibrating the carrier 120B via generation of electromagnetic force has been described above with reference to FIGS. 4 and 5, and thus a repeated description thereof will be omitted below.

Figure 9:
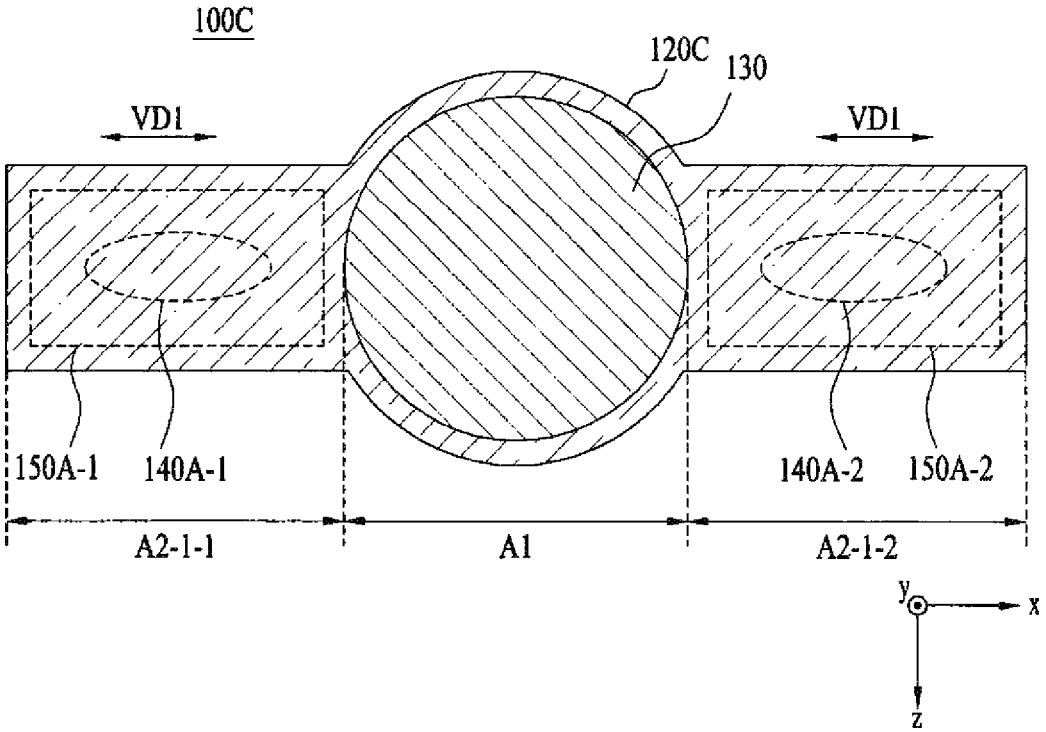
FIG. 9 is a plan view of a light-emitting apparatus according to another embodiment.
Figure 10:
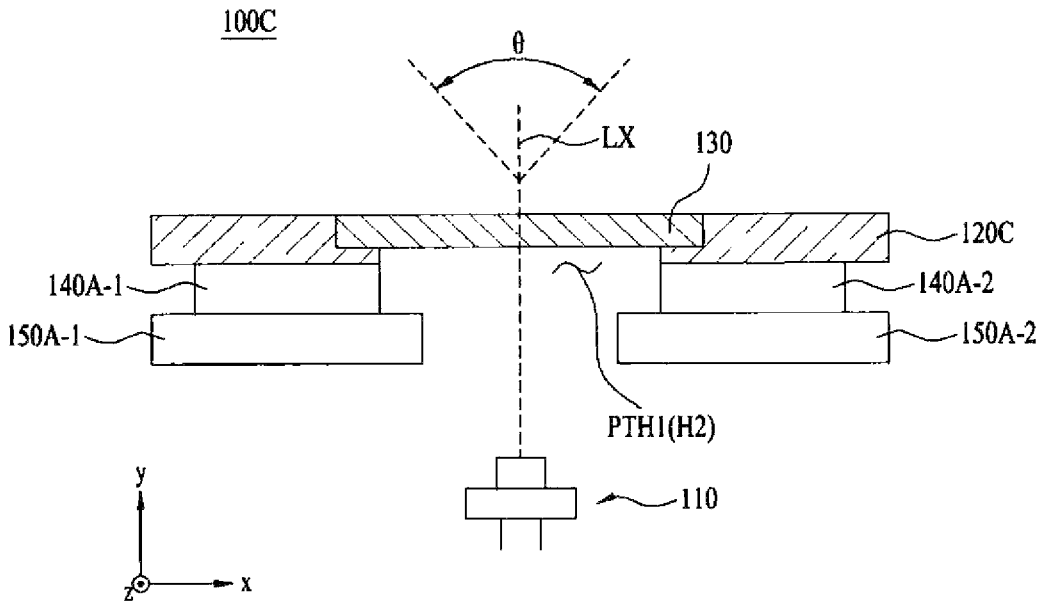
FIG. 10 is a sectional view of the light-emitting apparatus illustrated in FIG. 9 when viewed in the −Z-axis direction.

FIG. 9 is a plan view of a light-emitting apparatus 100C according to another embodiment, and FIG. 10 is a sectional view of the light-emitting apparatus 100C illustrated in FIG. 9 when viewed in the −Z-axis direction.

The light-emitting apparatus 100C illustrated in FIG. 9 may have any of various shapes in a sectional view excluding the sectional view illustrated in FIG. 10, and the light-emitting apparatus 100C illustrated in FIG. 10 may have any of various shapes in a plan view excluding the plan view illustrated in FIG. 9.

The light-emitting apparatus 100C illustrated in FIGS. 9 and 10 includes the light source 110, a carrier 120C, the wavelength converter 130, first-first and first-second coils 140A-1 and 140A-2, and first-first and first-second magnets 150A-1 and 150A-2. Here, although the light transmitting layer 112 illustrated in FIGS. 1 and 2 is omitted, of course, the light transmitting layer 112 may be located between the light source 110 and the wavelength converter 130 as illustrated in FIGS. 1 and 2.

To assist the understanding of the embodiment, in FIG. 9, the first-first and first-second coils 140A-1 and 140A-2 and the first-first and first-second magnets 150A-1 and 150A-2, hidden by the carrier 120C, are illustrated by dotted lines.

The light source 110, the wavelength converter 130, the first-first coil 140A-1, and the first-first magnet 150A-1 illustrated in FIGS. 9 and 10 are respectively the same as the light source 110, the wavelength converter 130, the coil 140A-1, and the 150A-1 illustrated in FIGS. 1 and 2, and thus are designated by the same reference numerals, and a detailed description thereof will be omitted below.

The carrier 120C illustrated in FIGS. 9 and 10 includes the first and second holes H1 and H2 illustrated in FIG. 3B. At this time, the carrier 120C corresponds to the case where the second width W2 and the first width W1 of the carrier 120A illustrated in FIG. 3B are the same and the thickness T and the depth D are the same.

Referring to FIGS. 9 and 10, the first area A1 is the area in which the wavelength converter 130 is placed as exemplarily illustrated in FIG. 3B.

The second-first area may include a plurality of second-first-first area A2-1-1 and second-first-second area A2-1-2 that extends from the first area A1 in one first vibration direction VD1 among the first and second vibration directions VD1 and VD2. Here, the second-first-first area A2-1-1 is as illustrated in FIGS. 3A and 3B. The second-first-second area A2-1-2 may be the area that extends from the first area A1 in the direction opposite to the direction in which the second-first-first area A2-1-1 extends. The first-first coil 140A-1 and the first-first magnet 150A-1 may be arranged in the second-first-first area A2-1-1, and the first-second coil 140A-2 and the first-second magnet 150A-2 may be arranged in the second-first-second area A2-1-2. The first-first and first-second magnets 150A-1 and 150A-2 may be arranged so as to be opposite to the first-first and first-second coils 140A-1 and 140A-2 respectively.

In addition, the first-first coil 140A-1 and the first-first magnet 150A-1 illustrated in FIGS. 9 and 10 may be arranged in the same form as the coil 140-1 and the magnet 150-1 illustrated in FIG. 4, and serve to vibrate the carrier 120C in the first vibration direction VD1. In addition, the first-second coil 140A-2 and the first-second magnet 150A-2 may be arranged in the same form as the coil 140-2 and the magnet 150-1 illustrated in FIG. 5, and serve to vibrate the carrier 120C in the first vibration direction VD1. The operation of vibrating the carrier 120C via generation of electromagnetic force has been described above with reference to FIGS. 4 and 5, and thus a repeated description thereof will be omitted below.

In addition, the second-first-first area A2-1-1 and the second-first-second area A2-1-2 may have symmetrical shapes in plan view.

Figure 11:
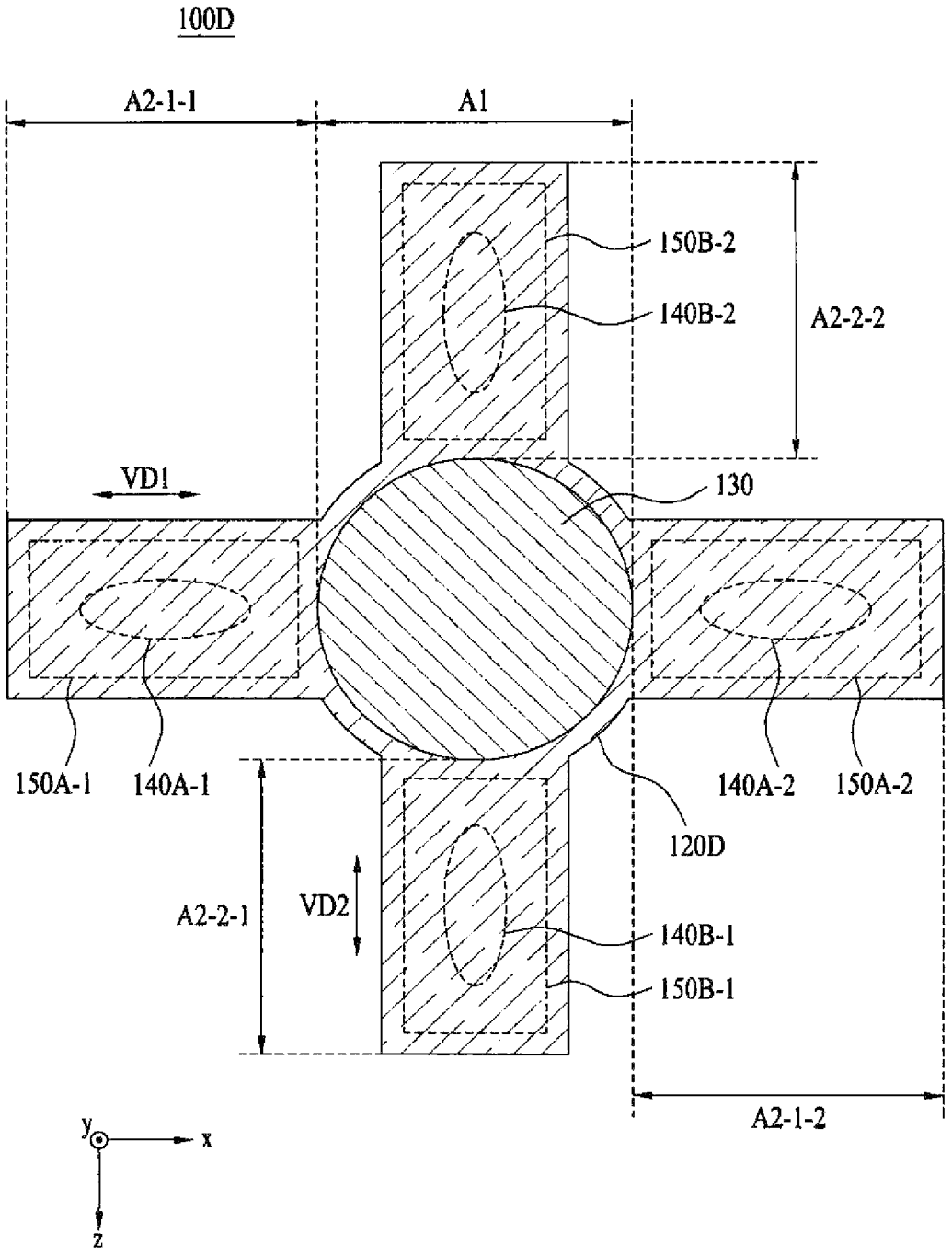
FIG. 11 is a plan view of a light-emitting apparatus according to another embodiment.
Figure 12:
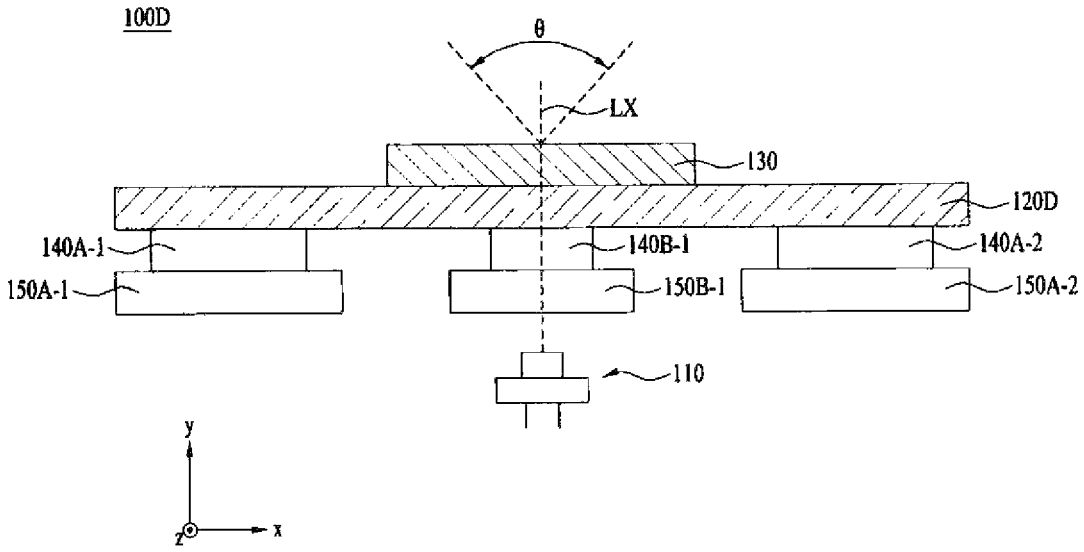
FIG. 12 is a sectional view of the light-emitting apparatus illustrated in FIG. 11 when viewed in the −Z-axis direction.

FIG. 11 is a plan view of a light-emitting apparatus 100D according to another embodiment, and FIG. 12 is a sectional view of the light-emitting apparatus 100D illustrated in FIG. 11 when viewed in the −Z-axis direction.

The light-emitting apparatus 100D illustrated in FIG. 11 may have any of various shapes in a sectional view excluding the sectional view illustrated in FIG. 12, and the light-emitting apparatus 100D illustrated in FIG. 12 may have any of various shapes in a plan view excluding the plan view illustrated in FIG. 11.

The light-emitting apparatus 100D illustrated in FIGS. 11 and 12 includes the light source 110, a carrier 120D, the wavelength converter 130, first-first, first-second, second-first, and second-second coils 140A-1, 140A-2, 140B-1 and 140B-2, and first-first, first-second, second-first, and second-second magnets 150A-1, 150A-2, 150B-1 and 150B-2. Here, although the light transmitting layer 112 illustrated in FIGS. 1 and 2 is omitted, of course, the light transmitting layer 112 may be located between the light source 110 and the wavelength converter 130 as illustrated in FIGS. 1 and 2.

To assist the understanding of the embodiment, in FIG. 11, the first-first, first-second, second-first, and second-second coils 140A-1, 140A-2, 140B-1 and 140B-2, and the first-first, first-second, second-first, and second-second magnets 150A-1, 150A-2, 150B-1 and 150B-2, hidden by the carrier 120D, are illustrated by dotted lines.

The light source 110, the wavelength converter 130, the first-first coil 140A-1, the second-first coil 140B-1, the first-first magnet 150A-1, and the second-first magnet 150B-1 illustrated in FIGS. 11 and 12 are respectively the same as the light source 110, the wavelength converter 130, the first-first coil 140A-1, the second-first coil 140B-1, the first-first magnet 150A-1, and the second-first magnet 150B-1 illustrated in FIGS. 7 and 8, and thus are designated by the same reference numerals, and a detailed description thereof will be omitted below. In addition, the first-second coil 140A-2 and the first-second magnet 150A-2 illustrated in FIGS. 11 and 12 are respectively the same as the first-second coil 140A-2 and the first-second magnet 150A-2 illustrated in FIGS. 9 and 10, and thus are designated by the same reference numerals, and a detailed description thereof will be omitted below.

The first area A1 illustrated in FIGS. 11 and 12 is the area in which the wavelength converter 130 is placed as exemplarily illustrated in FIG. 3B. Although the first area A1 may have the plan shape and the cross-sectional shape as illustrated in FIGS. 3A and 3B, the embodiment is not limited thereto.

The second-first area may include the second-first-first area A2-1-1 and the second-first-second area A2-1-2 that extend from the first area A1 in one first vibration direction VD1 among the first and second vibration directions VD1 and VD2. Here, the second-first-first area A2-1-1 is as illustrated in FIGS. 3A and 3B, and the second-first-second area A2-1-2 may be the same as the second-first-second area A2-1-2 illustrated in FIGS. 9 and 10. The first-first coil 140A-1 and the first-first magnet 150A-1 may be arranged in the second-first-first area A2-1-1, and the first-second coil 140A-2 and the first-second magnet 150A-2 may be arranged in the second-first-second area A2-1-2. The first-first and first-second magnets 150A-1 and 150A-2 may be arranged so as to be opposite to the first-first and first-second coils 140A-1 and 140A-2 respectively.

The second-second area may include the second-second-first area A2-2-1 and the second-second-second area A2-2-2 that extend from the first area A1 in the second vibration direction VD2 among the first and second vibration directions VD1 and VD2. Here, the second-second-first area A2-2-1 is as illustrated in FIGS. 7 and 8. The second-second-second area A2-2-2 may be the area that extends in the direction opposite to the direction in which the second-second-first area A2-2-1 extends from the first area A1. The second-first coil 140B-1 and the second-first magnet 150B-1 may be arranged in the second-second-first area A2-2-1, and the second-second coil 140B-2 and the second-second magnet 150B-2 may be arranged in the second-second-second area A2-2-2. The second-first and second-second magnets 150B-1 and 150B-2 may be arranged so as to be opposite to the second-first and second-second coils 140B-1 and 140B-2 respectively.

In addition, the first-first coil 140A-1 and the first-first magnet 150A-1 illustrated in FIGS. 11 and 12 may be arranged, in the same form as the coil 140-1 and the magnet 150-1 illustrated in FIG. 4, and serve to vibrate the carrier 120D in the first vibration direction VD1. Similarly, the first-second coil 140A-2 and the first-second magnet 150A-2 may be arranged in the same form as the coil 140-1 and the magnet 150-1 illustrated in FIG. 4, and serve to vibrate the carrier 120D in the first vibration direction VD1.

In addition, the second-first coil 140B-1 and the second-first magnet 150B-1 may be arranged in the same form as the coil 140-2 and the magnet 150-1 illustrated in FIG. 5, and serve to vibrate the carrier 1200 in the second vibration direction VD2. Similarly, the second-second coil 140B-2 and the second-second magnet 150B-2 may be arranged in the same form as the coil 140-2 and the magnet 150-1 illustrated in FIG. 5, and serve to vibrate the carrier 120D in the second vibration direction VD2. Here, the operation of vibrating the carrier 120D via generation of electromagnetic force has been described above with reference to FIGS. 4 and 5, and thus a repeated description thereof will be omitted below.

In addition, although the second-first-first area A2-1-1 and the second-first-second area A2-1-2 in FIGS. 11 and 12 may be symmetrical to each other with the first area A1 interposed therebetween and the second-second-first area A2-2-1 and the second-second-second area A2-2-2 may be symmetrical to each other with the first area A1 interposed therebetween, the embodiment is not limited thereto.

In the light-emitting apparatuses 100B to 100D illustrated in FIGS. 7 to 12, the different first and second vibration directions VD1 and VD2 in which the carriers 120B, 120C and 120D vibrate may be perpendicular to one another. In addition, each of the first and second vibration directions VD1 and VD2 may be perpendicular to the optical axis LX.

To ensure that the first and second vibration directions VD1 and VD2 are perpendicular to each other, in a plan view, the second-first area A2-1-1 and A2-1-2 and the second-second area A2-2-1 and A2-2-2 may be perpendicular to each other. However, in another embodiment, the first and second vibration directions VD1 and VD2 may not be perpendicular to each other. That is, the second-first area A2-1-1 and A2-1-2 and the second-second area A2-2-1 and A2-2-2 may not be perpendicular to each other.

In addition, each of the first and second vibration directions VD1 and VD2 may not be perpendicular to the optical axis LX. That is, the first vibration direction VD1 may be the x-axis that is perpendicular to the y-axis corresponding to the optical axis LX, and the second vibration direction VD2 may be the z-axis that is perpendicular to the y-axis corresponding to the optical axis LX. However, in another embodiment the first and second vibration directions VD1 and VD2 may not be perpendicular to the optical axis LX.

In addition, the levels of the current flowing through the respective first-first, first-second, second-first, and second-second coils 140A-1, 140A-2, 140B-1 and 140B-2 may be the same.

Alternatively, at least two levels of the current flowing through the first-first, first-second, second-first, and second-second coils 140A-1, 140A-2, 140B-1 and 140B-2 may be different.

In addition, the level of the current flowing through at least one of the first-first, first-second, second-first, or second-second coils 140A-1, 140A-2, 140B-1, or 140B-2 may be periodically or non-periodically changed.

For example, the current flowing through the first-first, first-second, second-first, and second-second coils 140A-1, 140A-2, 140B-1 and 140B-2 may have various forms illustrated in FIGS. 6A to 6D. That is, the current having the form illustrated in FIG. 6A, 6B, 6C or 6D may flow through each of the first-first, first-second, second-first, and second-second coils 140A-1, 140A-2, 140B-1 and 140B-2. At this time, the current flowing through the first-first, first-second, second-first, and second-second coils 140A-1, 140A-2, 140B-1 and 140B-2 may be the combination of various forms.

Electromagnetic force may be generated in various directions as at least one of the form of current or the period of current flowing through the first-first, first-second, second-first, and second-second coils 140A-1, 140A-2, 140B-1, and 140B-2 is changed in various ways, which may cause the carrier 120 to vibrate irregularly such that heat generated in the wavelength converter 130 and transferred to the carrier 120D may be rapidly dissipated. In particular, as exemplarily illustrated in FIGS. 11 and 12, the carrier 120D may stably vibrate when the second areas A2-1-1, A2-1-2, A2-2-1, and A2-2-2 are arranged in the symmetrical form.

Although the above-described embodiment describes the two vibration directions VD1 and VD2, the embodiment is not limited thereto. That is, there may be three or more vibration directions.

Although the above-described embodiments 100A, 100B, 100C, and 100D are illustrated as including one, two, or four second areas A2-1-1, A2-1-2, A2-2-1 and A2-2-2, the embodiments are not limited thereto. That is, in another embodiment, the second area may include at least one of the second-first-first, second-first-second, second-second-first, or second-second-second areas A2-1-1, A2-1-2, A2-2-1, or A2-2-2.

In addition, although one, two, or four coils 140A-1, 140A-2, 140B-1, and 140B-2 are illustrated, the embodiments are not limited thereto. That is, in another embodiment, the coil may include at least one of the first-first, first-second, second-first, or second-second coils 140A-1, 140A-2, 140B-1, or 140B-2.

In addition, although one, two, or four magnets 150A-1, 150A-2, 150B-1 and 150B-2 are illustrated, the embodiments are not limited thereto. That is, in another embodiment, the magnet may include at least one of the first-first, first-second, second-first, or second-second magnets 150A-1, 150A-2, 150B-1, or 150B-2.

In addition, so long as electromagnetic force may be generated in a desired direction based on Fleming's left-hand law described above in FIG. 4 or 5, the number and position of the corresponding coils and magnets of the above-described embodiments may be altered in various ways.

That is, although the above-described embodiments illustrate that one coil is opposite to one magnet, the embodiments are not limited thereto. That is, a plurality of coils may share a single magnet, and a plurality of magnets may share a single coil. In addition, in the above-described embodiment, although the coil and the magnet are illustrated as being attached to the bottom surface of the carrier, the coil and the magnet may be attached to at least one of the upper surface, the side surface, or the rear surface of the carrier.

Figure 13:
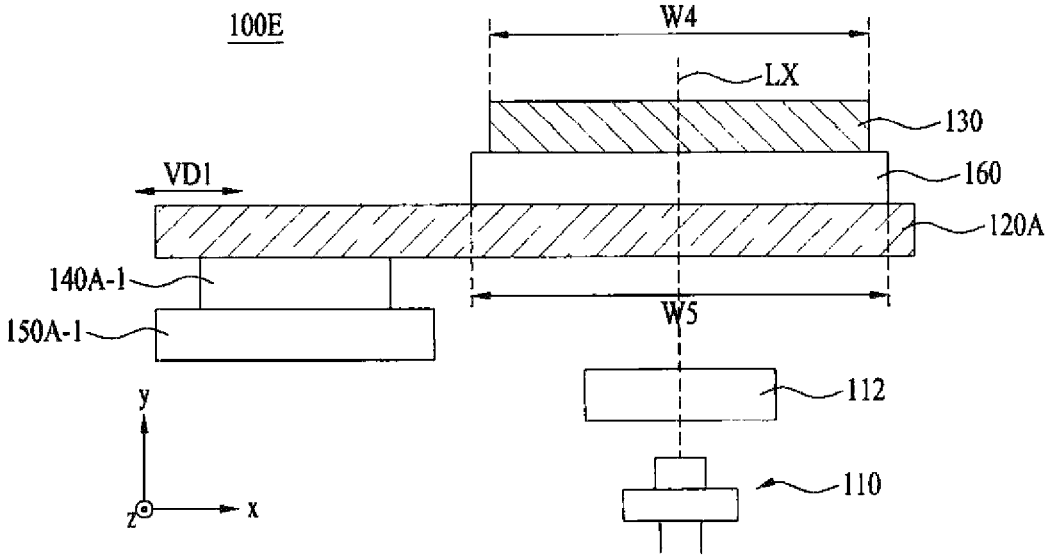
FIG. 13 is a sectional view of a light-emitting apparatus according to another embodiment.

FIG. 13 is a sectional view of a light-emitting apparatus 100E according to another embodiment.

Unlike the light-emitting apparatus 100A illustrated in FIG. 1, the light-emitting apparatus 100E illustrated in FIG. 13 may further include a radiator substrate 160. Except for this, the light-emitting apparatus 100E illustrated in FIG. 13 is the same as the light-emitting apparatus 100A illustrated in FIG. 1, and thus a repeated description thereof will be omitted below.

When the light source 110 includes laser diodes, an excited light emitted from the laser diodes may be concentrated on an extremely small area of phosphors included in the wavelength converter 130, thus causing the generation of excessive heat. Thereby, thermal quenching, which causes a considerable reduction in light output, may occur because the light conversion efficiency of the wavelength converter 130 is reduced. That is, excessive heat may deteriorate the wavelength conversion capability of the phosphors included in the wavelength converter 130. To solve this problem, in the light-emitting apparatus 100E of the embodiment, the radiator substrate 160 may be attached to the wavelength converter 130 which generates heat. The radiator substrate 160 may be located between the carrier 120A and the wavelength converter 130. Through the provision of the radiator substrate 160, heat generated in the wavelength converter 130 may be rapidly dissipated. To this end, the radiator substrate 160 may be formed of, for example, a light transmitting material such as $Al_2O_3$, and may be formed of a reflective material such as Al.

In addition, the fourth width W4 of the wavelength converter 130 and the fifth width W5 of the radiator substrate 160 may be the same. Alternatively, the fourth width W4 may be greater than or smaller than the fifth width W5. Although heat generated in the wavelength converter 130 may be more rapidly dissipated when the fifth width W5 is greater than the fourth width W4, the embodiment is not limited thereto.

Although not illustrated, even in the case of the light-emitting apparatuses 100B, 100C, and 100D illustrated in FIGS. 8, 10 and 12, the radiator substrate 160 having the form as illustrated in FIG. 13 may of course be located between the carrier 120B, 120C or 120D and the wavelength converter 130.

Figure 14:
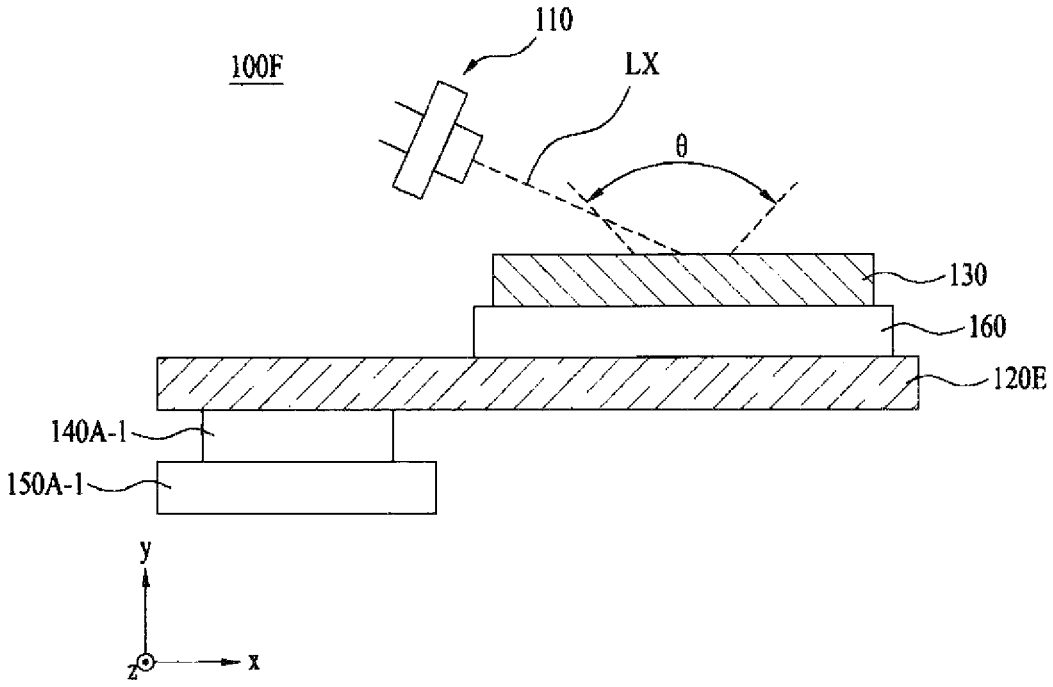
FIG. 14 is a sectional view of a light-emitting apparatus according to another embodiment.

FIG. 14 is a sectional view of a light-emitting apparatus 100F according to another embodiment.

The light-emitting apparatus 100F illustrated in FIG. 14 may include the light source 110, a carrier 120E, the wavelength converter 130, the first-first coil 140A-1, the first-first magnet 150A-1, and the radiator substrate 160.

Unlike the light-emitting apparatus 100D illustrated in FIG. 13 in which the light emitted from the light source 110 passes through the wavelength converter 130, in the case of the light-emitting apparatus 100F illustrated in FIG. 14, the light emitted from the light source 110 is reflected by the wavelength converter 130. Except for this, the light-emitting apparatus 100F illustrated in FIG. 14 is the same as the light-emitting apparatus 100E illustrated in FIG. 13, and thus are designated by the same reference numerals and a repeated description thereof will be omitted below. That is, the light source 110, the wavelength converter 130, the first-first coil 140A-1, and the first-first magnet 150A-1 illustrated in FIG. 14 respectively correspond to the light source 110, the wavelength converter 130, the coil 140A-1, and the magnet 150A-1 illustrated in FIG. 1.

Figure 15A:
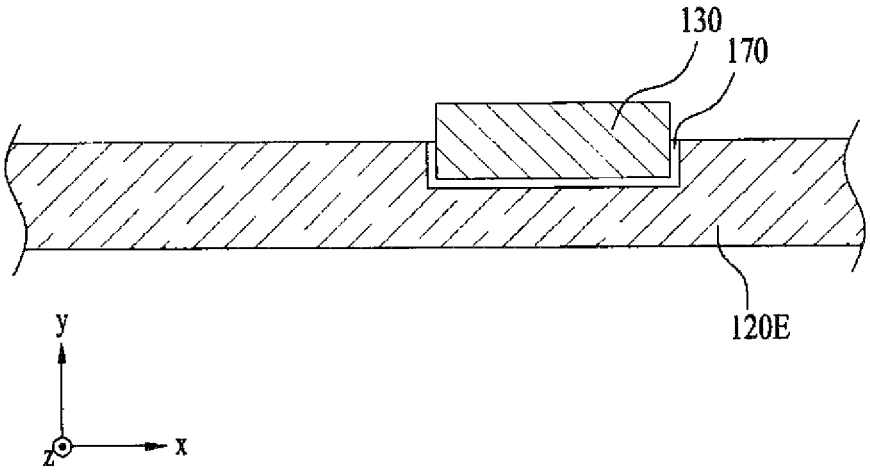
FIG. 15A is a sectional view illustrating a carrier and a wavelength converter according to the embodiment illustrated in FIG. 14.
Figure 15B:
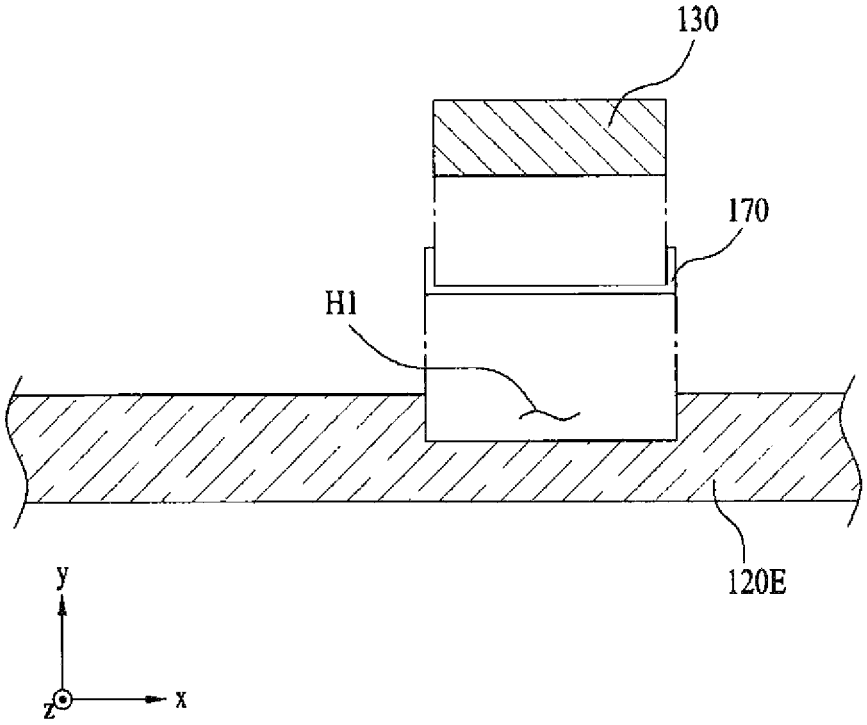
FIG. 15B is an exploded sectional view of the carrier and the wavelength converter illustrated in FIG. 15A.

FIG. 15A is a sectional view illustrating the carrier 120E and the wavelength converter 130 according to the embodiment illustrated in FIG. 14, and FIG. 15B is an exploded sectional view of the carrier 120E and the wavelength converter 130 illustrated in FIG. 15A.

Unlike the carrier 120A illustrated in FIG. 3B, the carrier 120E illustrated in FIG. 14 does not require the first through-hole PTH1 as illustrated in FIGS. 15A and 15B. This is because the light emitted from the light source 110 is reflected by the wavelength converter 130, rather than passing through the wavelength converter 130.

Here, the first hole H1 of the carrier 120E performs the same role as the first hole H1 illustrated in FIG. 3B. That is, the wavelength converter 130 may be mounted in, inserted into, placed in, or coupled to the first hole H1.

In addition, although not illustrated, the carrier 120E illustrated in FIGS. 15A and 15B may further include a second hole H2 which is deeper than the first hole H1 as illustrated in FIG. 3B. However, each of the first and second holes H1 and H2 may take the form of a blind hole.

In addition, the light-emitting apparatus 100E according to the embodiment may further include a reflective layer 170 as illustrated in FIGS. 15A and 15B. The reflective layer 170 may be located between the wavelength converter 130 and the first hole H1. Through the provision of the reflective layer 170, the light, emitted from the light source 110 and introduced into the wavelength converter 130, may be reflected without being observed by the carrier 120E, which may contribute to the improvement of light extraction efficiency. To this end, the reflective layer 170 may take the form of a film or sheet attached to the carrier 120E, or a coating applied to the carrier 120E. For example, the reflective layer 170 may be formed by coating the carrier 120E with a metal.

Although not illustrated, even in the case of each of the light-emitting apparatuses 100B, 100C and 100D illustrated in FIGS. 8, 10 and 12, the light emitted from the light source 110 may be reflected by the wavelength converter 130 as illustrated in FIG. 14, instead of passing through the wavelength converter 130.

Meanwhile, the light-emitting apparatuses 100A to 100F according to the above-described embodiments may be applied to various fields. For example, the light-emitting apparatuses 100A to 100F may be applied to lighting apparatuses such as, for example, a headlight for a vehicle, a lamp, or a signal light.

Figure 16:
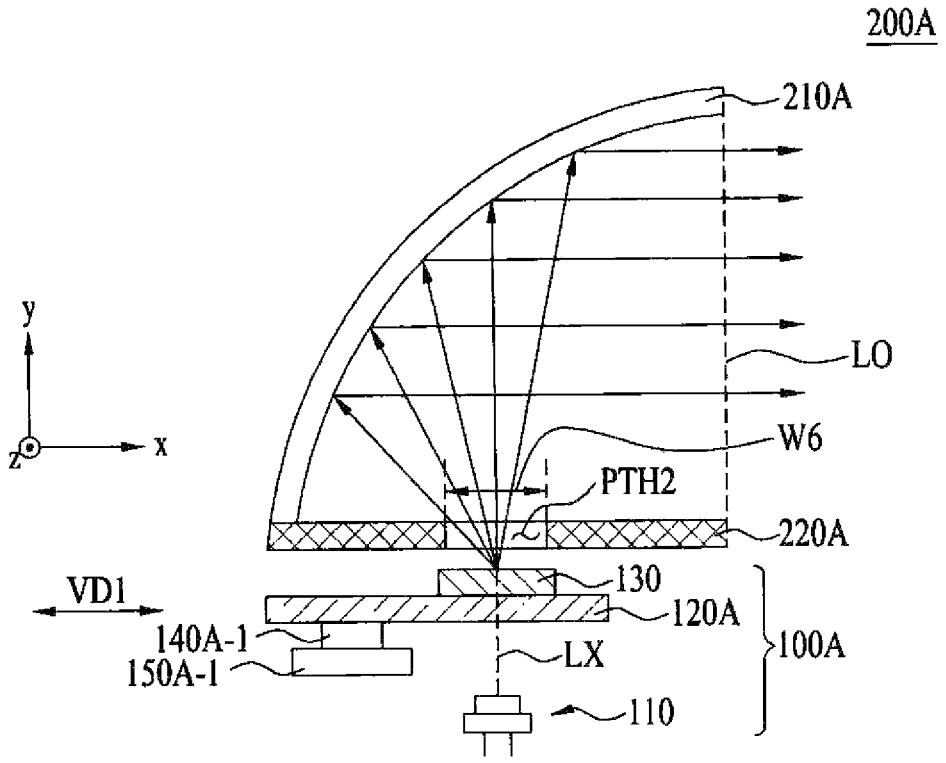
FIG. 16 is a sectional view of a lighting apparatus according to one embodiment.

FIG. 16 is a sectional view of a lighting apparatus 200A according to one embodiment.

The lighting apparatus 200A illustrated in FIG. 16 may include the light-emitting apparatus 100A, a reflector 210A, and a base substrate 220A. Here, the light source 110, the carrier 120A, the wavelength converter 130, the coil 140A-1, and the magnet 150A-1 included in the light-emitting apparatus 100A are the same as those illustrated in FIG. 1, and thus are designated by the same reference numerals, and a repeated description thereof will be omitted below.

The lighting apparatus 200A illustrated in FIG. 16 may include any one of the light-emitting apparatuses 100B, 100C and 100D illustrated in FIGS. 7 to 13, instead of the light-emitting apparatus 100A illustrated in FIG. 1.

The reflector 210A serves to reflect the light having passed through the wavelength converter 130 after being emitted from the light source 110. The reflector 210A may reflect light, the wavelength of which has been converted in the wavelength converter 130, as well as light, the wavelength of which has not been converted in the wavelength converter 130.

As illustrated, although the reflector 210A may have a round (or parabolic) cross-sectional shape, the embodiment is not limited thereto. When the reflector 210A has a round cross-sectional shape, this may be advantageous for the collimation of light emitted through an imaginary light emission surface LO. Upon the collimation of light, the lighting apparatus 200A may be usefully applied to a headlamp for a vehicle.

The base substrate 220A supports the reflector 210A and has a second through-hole PTH2, through which the light having passed through the wavelength converter 130 passes.

The wavelength converter 130 is placed below the base substrate 220A so as to be opposite to the second through-hole PTH2. Thus, the light having passed through the wavelength converter 130 may travel to the reflector 210A through the second through-hole PTH2.

In addition, in FIG. 16, although the vibration width of the carrier 120A in the first vibration direction VD1 may be smaller than a half W6/2 the sixth width W6 of the second through-hole PTH2 and greater than zero, the embodiment is not limited thereto.

Figure 17:
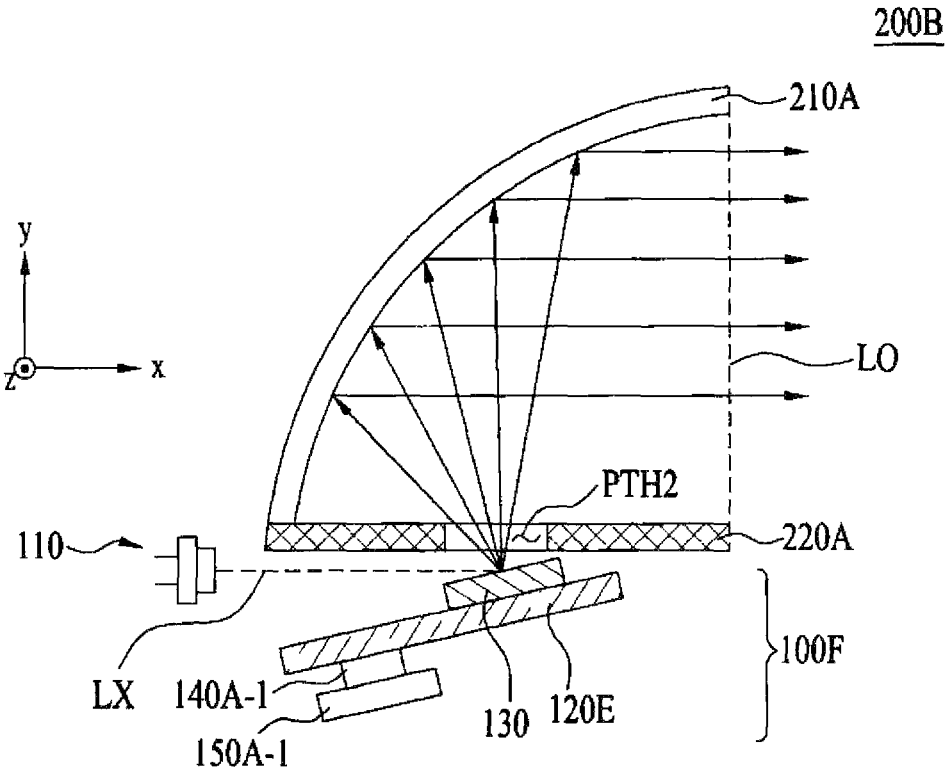
FIG. 17 is a sectional view of a lighting apparatus according to another embodiment.

FIG. 17 is a sectional view of a lighting apparatus 200B according to another embodiment.

The lighting apparatus 200B illustrated in FIG. 17 may include the light-emitting apparatus 100F, the reflector 210A, and the base substrate 220A. Here, the light source 110, the carrier 120E, the wavelength converter 130, the first-first coil 140A-1, and the first-first magnet 150A-1 included in the light-emitting apparatus 100F are the same as those illustrated in FIG. 14, and thus are designated by the same reference numerals, and a repeated description thereof will be omitted below.

The carrier 120A may be placed in the direction parallel to the base substrate 220A in the lighting apparatus 200A illustrated in FIG. 16, whereas the carrier 120E may be tilted, rather than being parallel to the base substrate 220A in the lighting apparatus 200B illustrated in FIG. 17. This serves to allow the wavelength converter 130 disposed above the carrier 120E to reflect the light emitted from the light source 110 so as to travel to the reflector 210A through the second through-hole PTH2. Except for this, the lighting apparatus 200B illustrated in FIG. 17 is the same as the lighting apparatus 200A illustrated in FIG. 16, and a detailed description thereof will be omitted.

Figure 18:
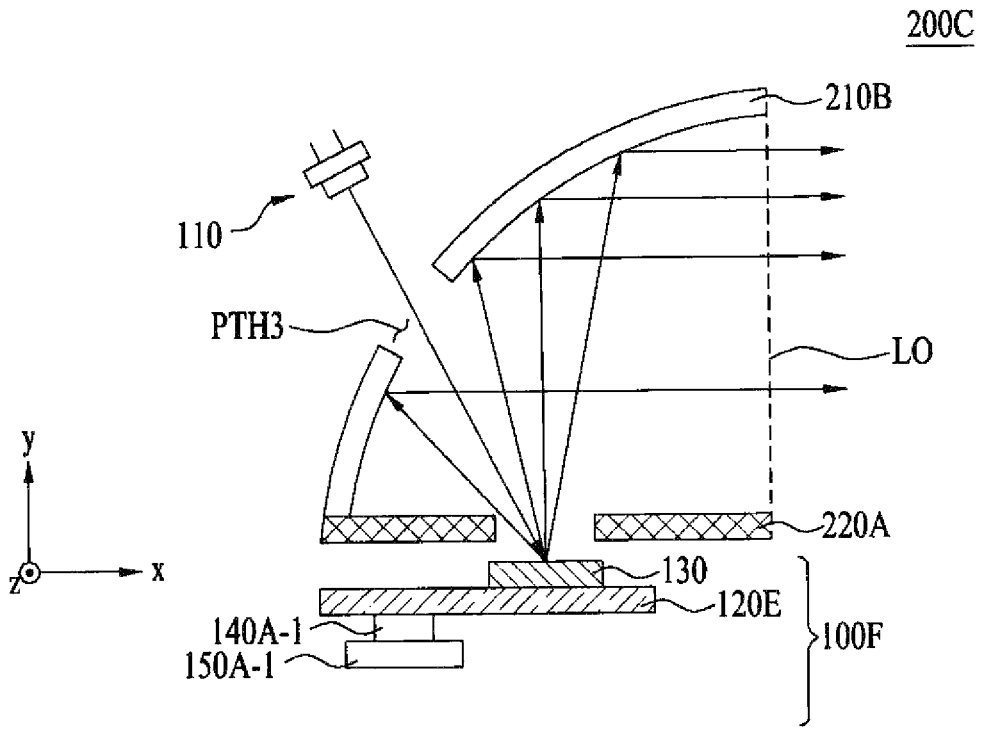
FIG. 18 is a sectional view of a lighting apparatus according to another embodiment.

FIG. 18 is a sectional view of a lighting apparatus 200C according to another embodiment.

The lighting apparatus 200C illustrated in FIG. 18 may include the light-emitting apparatus 100F, a reflector 210B, and the base substrate 220A. Here, the light source 110, the carrier 120E, the wavelength converter 130, the first-first coil 140A-1, and the first-first magnet 150A-1 included in the light-emitting apparatus 100F are the same as those illustrated in FIG. 14, and thus are designated by the same reference numerals, and a repeated description thereof will be omitted below.

The carrier 120E may be tilted, rather than being parallel to the base substrate 220A in the lighting apparatus 200B illustrated in FIG. 17, whereas the carrier 120E may be parallel to the base substrate 220A in the lighting apparatus 200C illustrated in FIG. 18.

In addition, unlike the reflector 210A illustrated in FIG. 17, the reflector 210B illustrated in FIG. 18 may include a third through-hole PTH3. Here, the third through-hole PTH3 serves to pass the light emitted from the light source 110 toward the wavelength converter 130.

In addition, the light source 110 may be spaced apart from the third through-hole PTH3 of the reflector 210B by a given distance. This serves to prevent heat generated from the light source 110 from having an effect on the reflector 210B.

Except for the above-described differences, the lighting apparatus 200C illustrated in FIG. 18 is the same as the lighting apparatus 200B illustrated in FIG. 17, and thus is designated by the same reference numerals, and a repeated description thereof will be omitted.

Figure 19:
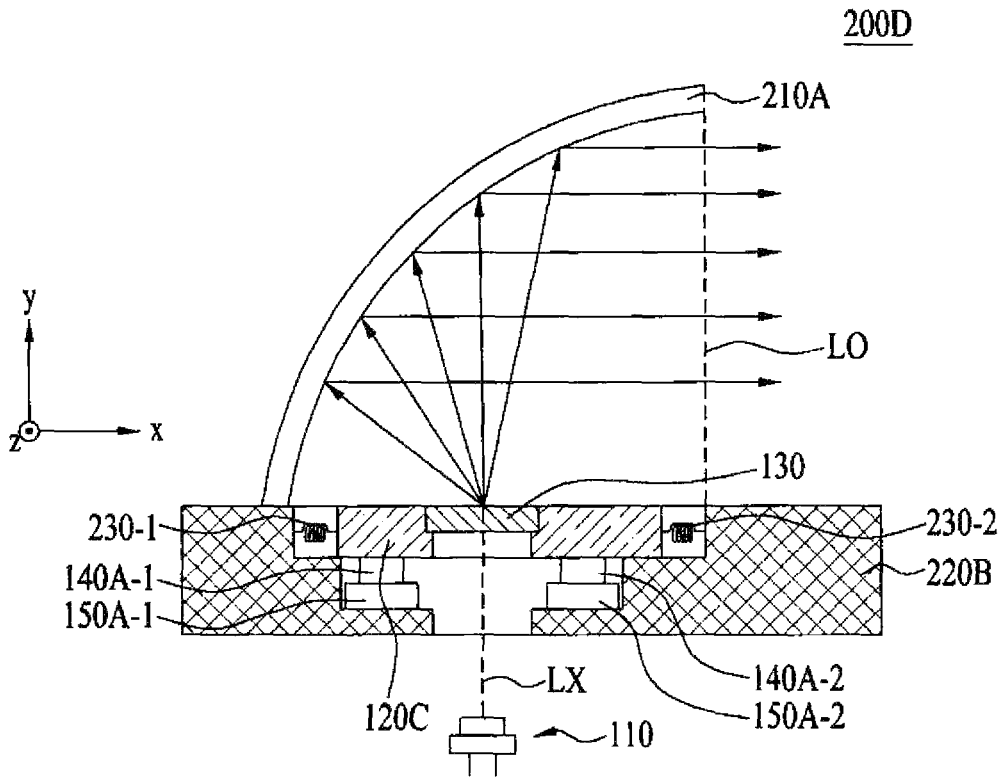
FIG. 19 is a sectional view of a lighting apparatus according to another embodiment.
Figure 20:
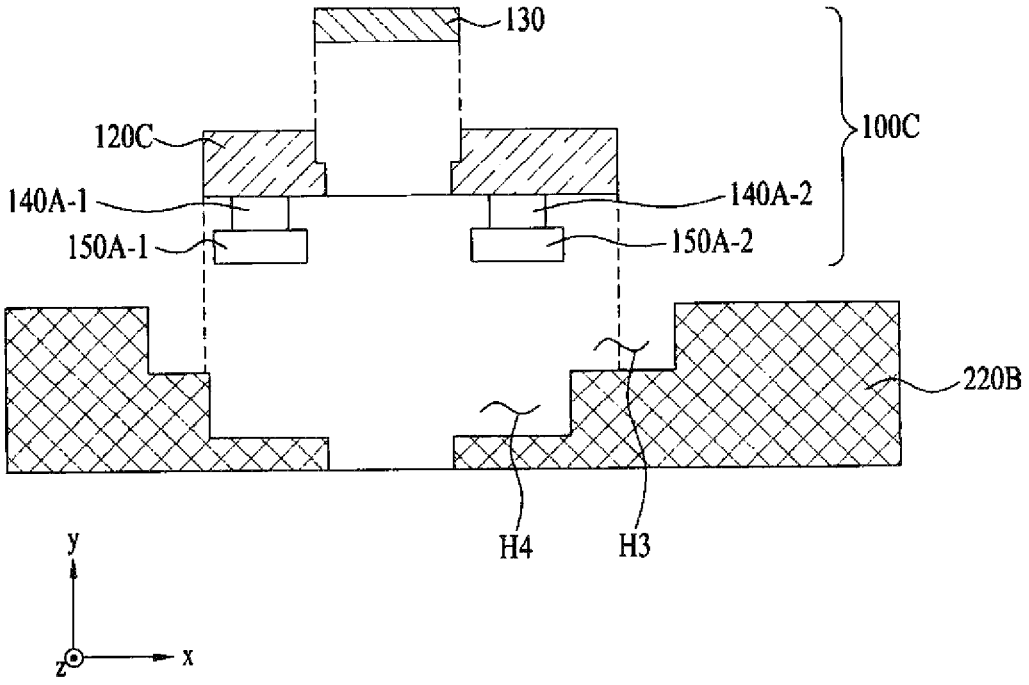
FIG. 20 is an exploded sectional view of a light-emitting apparatus and a base substrate illustrated in FIG. 19.

FIG. 19 is a sectional view of a lighting apparatus 200D according to another embodiment, and FIG. 20 is an exploded sectional view of the light-emitting apparatus 100C and a base substrate 220B illustrated in FIG. 19.

Referring to FIGS. 19 and 20, the lighting apparatus 200D includes the light-emitting device 100C, the reflector 210A, the base substrate 220B, and return springs 230-1 and 230-2. Here, the carrier 120C, the wavelength converter 130, the first-first coil 140A-1, the first-second coil 140A-2, the first-first magnet 150A-1, and the first-second magnet 150A-2 of the light-emitting apparatus 100C respectively correspond to the carrier 120C, the wavelength converter 130, the first-first coil 140A-1, the first-second coil 140A-2, the first-first magnet 150A-1, and the first-second magnet 150A-2 illustrated in FIG. 9, and thus are designated by the same reference numerals, and a repeated description thereof will be omitted below.

Although FIGS. 19 and 20 illustrate the lighting apparatus 200D as receiving the light-emitting apparatus 1000, the embodiment is not limited thereto. That is, in another embodiment, the lighting apparatus 200D illustrated in FIGS. 19 and 20 may of course receive any one of the light-emitting apparatuses 100A, 100B and 100D illustrated in FIGS. 1, 8 and 12, instead of the light-emitting apparatus 100C illustrated in FIG. 9. Even in this case, the following description may be applied.

Referring to FIG. 20, the base substrate 200B may include third and fourth holes H3 and H4 configured to receive the light-emitting apparatus 100C. The carrier 120C is seated in the third hole H3. The fourth hole H4 extends from the third hole H3, and the first-first coil 140A-1, the first-first magnet 150A-1, the first-second coil 140A-2, and the first-second magnet 150A-2 are seated in the fourth hole H4.

The return springs 230-1 and 230-2 are connected between the side portion of the carrier 120C and the base substrate 220B within the third hole H3 of the base substrate 220B. The return springs 230-1 and 230-2 serve to return the vibrating carrier 120C to an original position thereof.

Although not illustrated, when a plurality of light sources 110 is provided, light emitted from the light sources 110 may be gathered to any one location of the wavelength converter 130 by an optical system such as a lens.

As described above, when the carrier 120A, 120B, 120C, 120D or 120E vibrates in at least one vibration direction, for example, the first and/or second direction VD1 or VD2, heat generated in the wavelength converter 130 may be rapidly dissipated through the carrier 120A to 120E. In addition, when the carrier 120A to 120E vibrates in several directions, the heat radiation from the carrier 120A to 120E may be more efficiently performed compared to the case where the carrier 120A to 120E vibrates in a single direction.

In addition, a method for rotating the wavelength converter 130 may be used in order to solve the above-described thermal quenching. In this case, an additional motor is required to rotate the wavelength converter 130, which may result in excessive power consumption and a great volume of the light-emitting apparatus. In addition, in this case, alignment between the light source and the optical system may be difficult. However, by using electromagnetic force to vibrate the carrier 120A to 120E and attaching the coils and the magnets for the generation of electromagnetic force to the carrier 120A to 120E as in the above-described embodiment, power consumption may relatively be reduced and the attachment of the coils and the magnets may require a small space, which enables a reduction in the volume of the light-emitting apparatus, and consequently, a reduction in the size of the lighting apparatus. In addition, the light source 110 may be easily aligned with the light source module as the wavelength converter 130 slightly vibrates in the direction perpendicular to the optical axis LX at the initially aligned position while the light source 110 and the light source module of the optical system are stationary.

Figure 21:
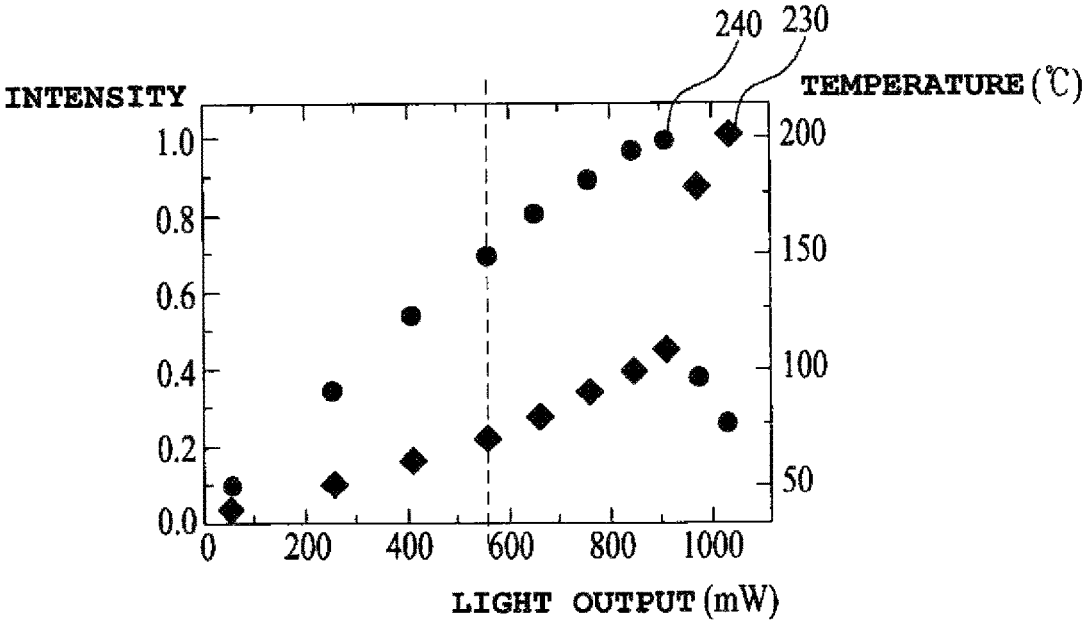
FIG. 21 is a graph illustrating the temperature and intensity of the wavelength converter depending on the output of a light source.

FIG. 21 is a graph illustrating the temperature and intensity of the wavelength converter 130 depending on the output of the light source 110. The horizontal axis represents the output of the light source 110, the right vertical axis represents the temperature 230 (° C.) of the wavelength converter 130, and the left vertical axis represents the intensity of light output from the wavelength converter 130, i.e. the normalized intensity 240.

Referring to FIG. 21, the wavelength converter 130 generally exhibits normal performance at the temperature of 200° C. In consideration of this, it can be appreciated that heat generated by the coil attached to the carrier 120A to 120E has no effect on the wavelength converter 130. That is, it can be appreciated that the wavelength converter 130 is not affected by heat generated from the coil attached to the carrier 120A to 120E because the heat generated in the wavelength converter 130 may be dissipated through the vibrating carrier 120A to 120E.

As is apparent from the above description, a light-emitting apparatus and a lighting apparatus including the same according to the embodiment may dissipate heat by vibrating a carrier using electromagnetic force, may be reduced in size because a coil, and a magnet used to generate electromagnetic force have a small volume, and may reduce power consumption compared to a method for rotating a wavelength converter.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light-emitting apparatus comprising:

a light, source;

a carrier spaced apart from the light source in an optical-axis direction;

a wavelength converter disposed in a first area of the carrier and configured to convert a wavelength of light emitted from the light source; and at least one coil and at least one magnet disposed in a second arca of the carrier and configured to generate electromagnetic force so as to vibrate the carrier in at least one vibration direction, the vibration direction being different from the optical-axis, direction, wherein the wavelength converter is disposed on an upper surface of the carrier, and wherein the at least one coil and the at least one magnet are disposed on a lower surface of the carrier.

2. The apparatus according to claim 1, wherein the carrier includes a first hole formed in the first area so as to receive the wavelength converter therein.

3. The apparatus according to claim 2, wherein the carrier further includes a second hole configured to face a bottom surface of the wavelength converter seated in the first hole, the second hole being deeper than the first hole.

4. The apparatus according to claim 3, wherein the carrier further includes a first through-hole for transmission of the light emitted from the light source toward the wavelength converter.

5. The apparatus according to claim 3, wherein the second hole includes a first through-hole for transmission of the light emitted from the light source toward the wavelength converter.

6. The apparatus according to claim 1, wherein the at least one vibration direction includes a plurality of different vibration directions, wherein the second area includes at least one of:

at least one second-first area extending from the first area in one vibration direction among the vibration directions; and at least one second-second area extending from the first area in another vibration direction among the vibration directions, wherein the at least one coil includes a plurality of coils arranged respectively in the second-first area and the second-second area, and wherein the at least one magnet includes a plurality of magnets arranged to be opposite to the respective coils.

7. The apparatus according to claim 6, wherein at least two of levels of current flowing through the respective coils are different.

8. The apparatus according to claim 6, wherein levels of current flowing through the respective coils are non-periodically changed.

9. The apparatus according to claim 6, wherein the at least one second-first area includes a second-first-first area and a second-first-second area arranged to be symmetrical to each other with the first area interposed therebetween, and wherein the at least one second-second area includes a second-second-first area and a second-second-second area arranged to be symmetrical to each other with the first area interposed therebetween.

10. The apparatus according to claim 1, further comprising a radiator substrate disposed between the carrier and the wavelength converter.

11. The apparatus according to claim 10, wherein the radiator substrate comprises a light transmitting material.

12. The apparatus according to claim 10, wherein the radiator substrate comprises a reflective material.

13. The apparatus according to claim 2, further comprising a reflective layer disposed between the wavelength converter and the first hole.

14. The apparatus according to claim 1, wherein the first area is located at or near a center of the carrier, and the second area is radially branched from the first area.

15. A lighting apparatus comprising:

the light-emitting apparatus according to claim 1; and a reflector configured to reflect light via the wavelength converter after being emitted from the light source.

16. The apparatus according to claim 15, further comprising a base substrate configured to support the reflector, the base substrate having a second through-hole for transmission of the light via the wavelength converter.

17. The apparatus according to claim 16, wherein the wavelength converter is disposed below the base substrate so as to be opposite to the second through-hole.

18. The apparatus according to claim 15, wherein the reflector includes a third through-hole for passage of the light emitted from the light source toward the wavelength converter.

19. The apparatus according to claim 16, wherein, the base substrate includes:

a third, hole seating of the carrier; and a fourth hole extending from the third hole for seating of the coil and the magnet.

20. The apparatus according to claim 19, further comprising a return spring, connected between a side portion of the carrier and the base substrate within the third hole of the base substrate.

* * * * *